US008399165B2

(12) United States Patent
Fuchigami

(10) Patent No.: US 8,399,165 B2
(45) Date of Patent: Mar. 19, 2013

(54) COATING FLUID FOR FORMING UNDERCOAT LAYER AND ELECTROPHOTOGRAPHIC PHOTORECEPTOR HAVING UNDERCOAT LAYER FORMED BY APPLYING SAID COATING FLUID

(75) Inventor: Hiroe Fuchigami, Odawara (JP)

(73) Assignee: Mitsubishi Chemical Corporation, Tokyo (JP)

( * ) Notice: Subject to any disclaimer, the term of this patent is extended or adjusted under 35 U.S.C. 154(b) by 0 days.

(21) Appl. No.: 12/612,982

(22) Filed: Nov. 5, 2009

(65) Prior Publication Data

US 2010/0054810 A1 Mar. 4, 2010

Related U.S. Application Data

(62) Division of application No. 11/719,817, filed as application No. PCT/JP2005/018308 on Oct. 3, 2005.

(30) Foreign Application Priority Data

Nov. 19, 2004 (JP) ..... 2004-336424

(51) Int. Cl.
*G03G 15/00* (2006.01)
*G03G 5/04* (2006.01)

(52) U.S. Cl. ..... 430/64; 400/65; 399/116

(58) Field of Classification Search ..... 399/116; 430/64, 65

See application file for complete search history.

(56) References Cited

U.S. PATENT DOCUMENTS 5,730,793 A 3/1998 Nakamura et al.
5,882,246 A 3/1999 Inkyo et al.
6,214,506 B1 4/2001 Kurihara et al.
6,399,263 B1 6/2002 Hayata
6,824,938 B2 * 11/2004 Kizaki et al. ..... 430/60
7,217,483 B2 * 5/2007 Nozomi et al. ..... 430/96
7,244,535 B2 * 7/2007 Kumano ..... 430/96
7,358,018 B2 * 4/2008 Taguchi ..... 430/69
7,473,507 B2 * 1/2009 Kumano ..... 430/96
7,718,337 B2 * 5/2010 Kumano ..... 430/96
2001/0019804 A1 9/2001 Kurihara et al.
2002/0094487 A1 * 7/2002 Kawasaki ..... 430/58.05
2003/0073014 A1 * 4/2003 Fujita et al. ..... 430/65
2003/0096180 A1 * 5/2003 Kizaki et al. ..... 430/60
2003/0118869 A1 * 6/2003 Ozawa et al. ..... 428/694 BH (Continued)

FOREIGN PATENT DOCUMENTS

CN 1252541 A 5/2000
CN 1430102 A 7/2003

(Continued)

OTHER PUBLICATIONS

U.S. Appl. No. 12/613,023, filed Nov. 5, 2009, Fuchigami.

(Continued)

*Primary Examiner* — Hoa V Le
(74) *Attorney, Agent, or Firm* — Oblon, Spivak, McClelland, Maier & Neustadt, L.L.P.

(57) ABSTRACT

To provide a coating fluid for forming an undercoat layer having high stability, a high quality and long-life electrophotographic photoreceptor capable of forming a high quality image in various environments, with which image defects such as black spots or color spots hardly occur, an image forming apparatus using such a photoreceptor, and an electrophotographic cartridge using such a photoreceptor.

A coating fluid for forming un undercoat layer of an electrophotographic photoreceptor containing titanium oxide particles and a binder resin, characterized in that titanium oxide agglomerated secondary particles in the coating fluid have a volume average particle size of at most 0.1 μm and a cumulative 90% particle size of at most 0.3 μm.

22 Claims, 3 Drawing Sheets

U.S. PATENT DOCUMENTS

| | | | | |
|---|---|---|---|---|
| 2003/0118927 | A1* | 6/2003 | Nakamura et al. | 430/65 |
| 2003/0175605 | A1* | 9/2003 | Katayama et al. | 430/59.4 |
| 2005/0019683 | A1* | 1/2005 | Tomoyori et al. | 430/63 |
| 2005/0064318 | A1* | 3/2005 | Shida et al. | 430/126 |
| 2005/0100803 | A1* | 5/2005 | Suzuki | 430/65 |
| 2005/0112484 | A1* | 5/2005 | Nozoe et al. | 430/60 |
| 2005/0123846 | A1* | 6/2005 | Kinoshita | 430/60 |
| 2006/0222979 | A1* | 10/2006 | Ishida et al. | 430/72 |
| 2006/0269857 | A1* | 11/2006 | Hayata et al. | 430/60 |
| 2007/0026333 | A1* | 2/2007 | Wu et al. | 430/66 |
| 2007/0048640 | A1* | 3/2007 | Wu et al. | 430/60 |
| 2009/0136861 | A1 | 5/2009 | Mitsumori et al. | |
| 2009/0202274 | A1 | 8/2009 | Mitsumori et al. | |
| 2009/0208249 | A1 | 8/2009 | Fuchigami et al. | |
| 2009/0208250 | A1 | 8/2009 | Mitsumori et al. | |
| 2009/0232552 | A1 | 9/2009 | Mitsumori et al. | |
| 2009/0257776 | A1 | 10/2009 | Mitsumori et al. | |

FOREIGN PATENT DOCUMENTS

| | | | |
|---|---|---|---|
| CN | 1495550 | A | 5/2004 |
| EP | 0 977 089 | A1 | 2/2000 |
| JP | 4-350664 | | 12/1992 |
| JP | 4-353860 | | 12/1992 |
| JP | 06-273962 | | 9/1994 |
| JP | 8 166678 | | 6/1996 |
| JP | 10 69116 | | 3/1998 |
| JP | 10-69116 | | 3/1998 |
| JP | 11-202519 | | 7/1999 |
| JP | 2001-188376 | | 7/2001 |
| JP | 3337152 | | 8/2002 |
| JP | 2003-84472 | | 3/2003 |
| JP | 3400836 | | 4/2003 |
| JP | 2003-131405 | | 5/2003 |
| JP | 2004-77975 | | 3/2004 |
| JP | 2004 198593 | | 7/2004 |
| WO | WO 96/39251 | | 12/1996 |

OTHER PUBLICATIONS

U.S. Appl. No. 12/300,943, filed Nov. 14, 2008, Mitsumori et al.

U.S. Appl. No. 13/188,743, filed Jul. 22, 2011, Fuchigami.

Chinese Office Action issued on Mar. 30, 2011 in corresponding Chinese Application No. 200910150387.8 (with an English Translation).

Extended Search Report issued Apr. 29, 2011 in Europe Application No. 10003599.7.

Extended European Search Report issued May 10, 2011, in Patent Application No. 10003600.3.

Office Action issued Jul. 6, 2011, in Chinese Patent Application No. 200910150392.9 with English translation.

European Office Action issued Jan. 27, 2012 in patent application No. 05 788 341.5.

* cited by examiner

COATING FLUID FOR FORMING UNDERCOAT LAYER AND ELECTROPHOTOGRAPHIC PHOTORECEPTOR HAVING UNDERCOAT LAYER FORMED BY APPLYING SAID COATING FLUID

CROSS REFERENCE TO RELATED APPLICATIONS

This application is a divisional application of prior U.S. patent application Ser. No. 11/719,817, the disclosure of which is incorporated by reference in its entirety. U.S. Ser. No. 11/719,817 is a National Stage of PCT/JP05/18308 filed on Oct. 3, 2005 which claims the benefit of priority under 35 U.S.C §119 from Japanese Patent Application No. 2004-336424, filed Nov. 19, 2004, the disclosures of which are incorporated herein by reference in their entireties.

TECHNICAL FIELD

The present invention relates to a method for producing a coating fluid for forming an undercoat layer to be used for formation of an undercoat layer of an electrophotographic photoreceptor by coating and drying, a photoreceptor comprising an undercoat layer formed by applying a coating fluid by the above method and a photosensitive layer formed on the undercoat layer, an image forming apparatus using the photoreceptor, and an electrophotoconductive cartridge using the photoreceptor. An electrophotographic photoreceptor having a photosensitive layer formed on an undercoat layer formed by applying and drying a coating fluid for forming an undercoat layer obtained by the production method of the present invention is suitably used for e.g. an electrophotographic printer, a facsimile, a copying machine, etc.

BACKGROUND ART

An electrophotographic technology has found wide spread application not only in the field of copying machines but also in the field of various printers because it can provide an image of immediacy and high quality. As for the photoreceptor which is the core of the electrophotographic technology, organic photoreceptors using, as their photoconductive materials, organic photoconductive materials having advantages of entailing no pollution, being easy to manufacture, and the like, as compared with inorganic photoconductive materials, have been used. Usually, organic photoreceptors have an electroconductive substrate and a photosensitive layer formed on the substrate, and as such organic photoreceptors, there are known a so-called dispersion type photoreceptor having a single photosensitive layer obtained by dissolving or dispersing a photoconductive material in a binder resin; and a so-called lamination type photoreceptor having a plurality of photosensitive layers, obtained by laminating a charge generation layer containing a charge generation material and a charge transport layer containing a charge transport material.

By the use of an organic photoreceptor, an image formed by using the photoreceptor may have various defects in some cases due to a change of the use environment or the change of electric characteristics, etc. by repeated use, and in order to stably form favorable images, a method has been known to provide an undercoat layer containing a binder resin and titanium oxide particles between the electroconductive substrate and the photosensitive layer (e.g. Patent Document 1).

Layers which an organic photoreceptor have are usually formed by applying and drying a coating fluid having a material dissolved or dispersed in a solvent in view of high productivity. However, in an undercoat layer containing titanium oxide particles and a binder resin, the titanium oxide particles and the binder resin are present in a state where they are incompatible with each other in the undercoat layer, and accordingly the undercoat layer is formed by applying a coating fluid for forming an undercoat layer having titanium oxide particles dispersed therein. Heretofore, such a coating fluid has been commonly produced by subjecting titanium oxide particles to wet dispersion in an organic solvent by a know mechanical grinding apparatus such a ball mill, a sand grinding mill, a planetary mill or a roll mill over a long period of time (e.g. Patent Document 1). It has been disclosed that in a case where titanium oxide particles in a coating fluid for forming an undercoat layer are dispersed by using a dispersing medium, an electrophotographic photoreceptor excellent in charge/exposure repeating characteristics can be provided even under low temperature and low humidity conditions by the material of the dispersing medium being titania or zirconia (e.g. Patent Document 2). However, conventional technology still has various insufficiencies of performance in view of the image, the stability of the coating fluid at the time of production, etc., along with increasing demands for formation of higher quality images.

Patent Document 1: JP-A-11-202519

Patent Document 2: JP-A-6-273962

DISCLOSURE OF THE INVENTION

Object to be Accomplished by the Invention

The present invention has been made in consideration of the above background art of the electrophotographic technology, and its object is to provide a coating fluid for forming an undercoat layer having high stability, a high performance electrophotographic photoreceptor capable of forming a high quality image under various use environments, which hardly develops image defects such as black spots or color spots, an image forming apparatus using the photoreceptor, and an electrophotographic cartridge using the above photoreceptor.

Means to Accomplish the Object

The present inventors have conductive extensive studies on the above object and as a result, they have found the following. Namely, a coating fluid for forming an undercoat layer excellent in stability at the time of use can be obtained by using, as a dispersing medium to be utilized to disperse titanium oxide particles in a coating fluid for forming an undercoat layer, a dispersing medium having a particularly small particle size as compared with the particle size of a commonly used dispersing medium; an electrophotographic photoreceptor having an undercoat layer obtained by applying and drying such a coating fluid has favorable electric characteristics in various use environments; and by an image forming apparatus using such a photoreceptor, a high quality image can be formed, and image defects such as black spots or color spots considered to be generated by dielectric breakdown or the like hardly develop. The present invention has been accomplished on the basis of these discoveries.

Namely, the present invention provides the following.

(1) A coating fluid for forming un undercoat layer of an electrophotographic photoreceptor containing metal oxide particles and a binder resin, characterized in that metal oxide agglomerated secondary particles in the coating fluid have a volume average particle size of at most 0.1 μm and a cumulative 90% particle size of at most 0.3 μm.

(2) A coating fluid for forming un undercoat layer of an electrophotographic photoreceptor containing metal oxide particles and a binder resin, characterized by containing metal oxide particles subjected to dispersion treatment by using a wet grinding ball mill which comprises a cylindrical stator, a slurry feed opening provided on one end of the stator, a slurry outlet provided on the other end of the stator, a rotor stirring and mixing a medium put in the stator and a slurry supplied through the feed opening, and an impeller type separator as a separator communicating with the outlet and rotating together with or separately from the rotor to separate the medium and the slurry by the action of centrifugal force and to discharge the slurry from the outlet, wherein a shaft center of a shaft rotating the separator is a hollow exhaust passage communicating with the outlet, or wherein the separator comprises two disks having a fitting groove for a blade on the inner surfaces facing each other, a blade interposed between the disks fitted to the fitting groove, and a supporting means sandwiching the disks having the blade interposed therebetween; and a method for producing such a coating fluid for forming an undercoat layer.

(3) A coating fluid for forming un undercoat layer of an electrophotographic photoreceptor containing a binder resin and metal oxide particles, characterized in that of a liquid obtained by diluting the coating fluid with a solvent mixture of methanol and 1-propanol in a weight ratio of 7:3, the difference between the absorbance to a light having a wavelength of 400 mm and the absorbance to a light having a wavelength of 1,000 nm, is at most 1.0 (Abs) in a case where the refractive index of the metal oxide particles is at least 2.0, or 0.05 (Abs) in a case where the refractive index of the metal oxide particles is at most 2.0; and an electrophotographic photoreceptor comprising an electroconductive substrate and an undercoat layer formed on the electroconductive substrate by applying the coating fluid.

(4) A method for producing a coating fluid for forming an undercoat layer of an electrophotographic photoreceptor containing metal oxide particles and a binder resin, characterized in that the metal oxide particles are metal oxide particles dispersed by using a dispersing medium having an average particle size of from 5 to 200 μm; and an electrophotographic photoreceptor comprising an undercoat layer formed by applying the coating fluid for forming an undercoat layer produced by the production method.

(5) An electrophotographic photoreceptor, comprising an electroconductive substrate, an undercoat layer containing a binder resin and metal oxide particles on the electroconductive substrate, and a photosensitive layer formed on the undercoat layer, characterized in that in a dispersion having the undercoat layer dispersed in a solvent mixture of methanol and 1-propanol in a weight ratio of 7:3, metal oxide agglomerated secondary particles have a volume average particle size of at most 0.1 μm and a cumulative 90% particle size of at most 0.3 μm.

(6) An electrophotographic photoreceptor, comprising an electroconductive substrate, an undercoat layer containing a binder resin and metal oxide particles on the electroconductive substrate, and a photosensitive layer formed on the undercoat layer, characterized in that of a dispersion having the undercoat layer dispersed in a solvent mixture of methanol and 1-propanol in a weight ratio of 7:3, the difference between the absorbance to a light having a wavelength of 400 nm and the absorbance to a light having a wavelength of 1,000 nm, is at most 0.3 (Abs) in a case where the refractive index of the metal oxide particles is at least 2.0, or at most 0.02 (Abs) in a case where the refractive index of the metal oxide particles is at most 2.0.

(7) An electrophotographic photoreceptor, comprising an electroconductive substrate, an undercoat layer containing a binder resin and metal oxide particles on the electroconductive substrate, and a photosensitive layer formed on the undercoat layer, characterized in that the in-plane root mean square roughness (RMS) of the surface of the undercoat layer is from 10 to 100 nm, the in-plane arithmetic mean roughness (Ra) is from 10 to 50 nm, and the in-plane maximum roughness (P-V) is from 100 to 1,000 nm, as measured by a surface irregularities measuring apparatus combining high precision phase shift detection method and order counting of interference fringes using an optical interferometer.

(8) An electrophotographic photoreceptor, comprising an electroconductive substrate, an undercoat layer containing a thermoplastic resin and metal oxide particles and having a thickness of at most 6 um on the electroconductive substrate, and a photosensitive layer formed on the undercoat layer, characterized in that the proportion by weight of the metal oxide particles to the thermoplastic resin is at least 2, and the dielectric breakdown voltage is at least 4 kV.

(9) An electrophotographic photoreceptor, comprising an electroconductive substrate, an undercoat layer containing a binder resin and metal oxide particles on the electroconductive substrate, and a photosensitive layer formed on the undercoat layer, characterized in that in a case where the refractive index of the metal oxide particles is at least 2.0, the ratio of the specular reflection of the undercoat layer calculated as a thickness of 2 μm to a light having a wavelength of 480 nm, to the specular reflection of the electroconductive substrate to a light having a wavelength of 480 nm, is at least 50%, and in a case where the refractive index of the metal oxide particles is at most 2.0, the ratio of the specular reflection of the undercoat layer calculated as a thickness of 2 μm to a light having a wavelength of 400 nm, to the specular reflection of the electroconductive substrate to a light having a wavelength of 400 nm, is at least 50%.

(10) An image forming apparatus comprising the electrophotographic photoreceptor of the present invention, a charging means to charge the photoreceptor, an exposure means to expose the charged photoreceptor to form an electrostatic latent image, a developing means to develop the latent image with a toner, and a transfer means to transfer the toner to an object to which the toner is to be transferred; and such an image forming apparatus, characterized in that the charging means is disposed to be in contact with the electrophotographic photoreceptor.

(11) An image forming apparatus comprising the electrophotographic photoreceptor of the present invention, a charging means to charge the photoreceptor, an exposure means to expose the charged photoreceptor to form an electrostatic latent image, a developing means to develop the latent image with a toner, and a transfer means to transfer the toner to an object to which the toner is to be transferred, characterized in that the wavelength of a light to be used for the exposure means is from 350 nm to 600 nm.

(12) An electrophotographic cartridge comprising at least one of the electrophotographic photoreceptor of the present invention, a charging means to charge the photoreceptor, an exposure means to expose the charged photoreceptor to form an electrostatic latent image, a developing means to develop the latent image with a toner, and a transfer means to transfer the toner to an object to which the toner is to be transferred; and such an electrophotographic cartridge, characterized in that the charging means is disposed to be in contact with the electrophotographic photoreceptor.

Effects of the Invention

According to the present invention, the coating fluid for forming an undercoat layer is in a stable state and will not gelate, and the dispersed titanium oxide particles will not be precipitated, whereby the coating fluid can be stored or used for a long period of time. Further, changes in physical properties such as the viscosity at the time of use of the coating fluid are small, and when it is continuously applied to a substrate and dried to form photosensitive layers, the thicknesses of the respective produced photosensitive layers will be uniform. Further, an electrophotographic photoreceptor comprising an undercoat layer formed by using the coating fluid produced by the method of the present invention has stable electric characteristics even at low temperature and low humidity and is excellent in electric characteristics. Further, by an image forming apparatus using the electrophotographic photoreceptor of the present invention, favorable images with very few image defects such as black spots or color spots will be formed. Particularly by an image forming apparatus to be charged by a charging means disposed to be in contact with the electrophotographic photoreceptor, favorable images with very few image defects such as black spots or color spots can be formed. Further, by an image forming apparatus using the electrophotographic photoreceptor of the present invention, in which the wavelength of a light to be used for an exposure means is from 350 nm to 600 nm, high quality images can be formed due to high initial charge potential and high sensitivity.

MEANINGS OF SYMBOLS

Figure 1:
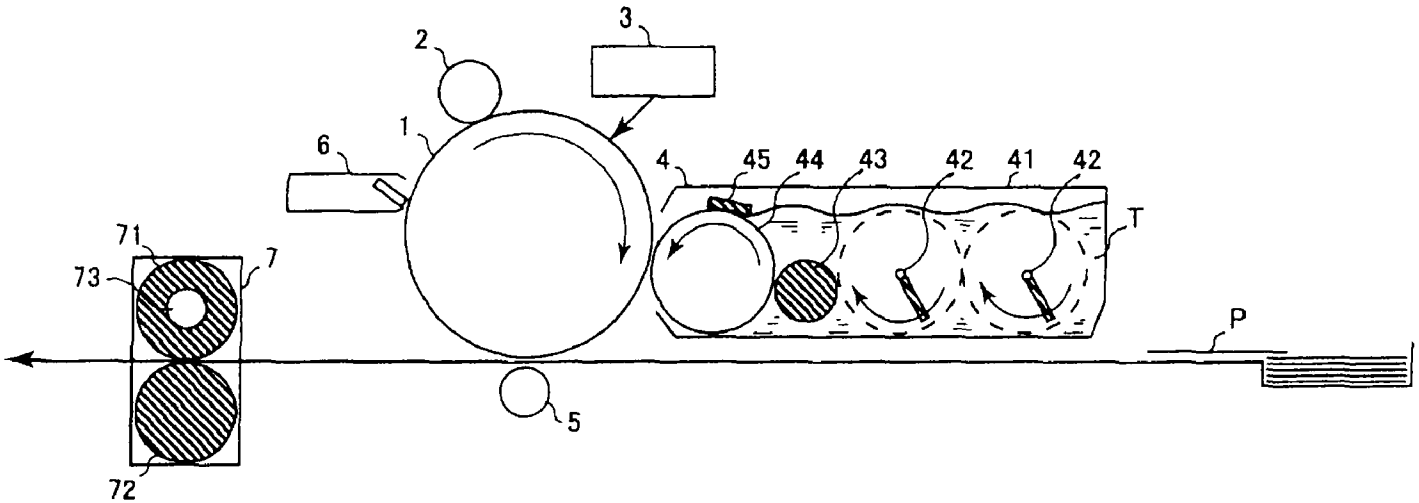
FIG. 1 is a drawing schematically illustrating a structure of a substantial part of one embodiment of an image forming apparatus having an electrophotographic photoreceptor of the present invention.

1 Photoreceptor, 2 charging apparatus (charging roller), 3 exposure apparatus, 4 developing apparatus, 5 transfer apparatus, 6 cleaning apparatus, 7 fixing apparatus, 41 developing tank, 42 agitator, 43 supply roller, 44 developing roller, 45 control member, 71 upper fixing member (fixing roller), 72 lower fixing member (fixing roller), 73 heating apparatus, T toner, P recording paper (paper sheet, medium), 14 separator, 15 shaft, 16 jacket, 17 stator, 19 exhaust passage, 21 rotor, 24 pulley, 25 rotary joint, 26 raw slurry feed opening, 27 screen support, 28 screen, 29 product slurry outlet, 31 disk, 32 blade, 35 valve

BEST MODE FOR CARRYING OUT THE INVENTION

Now, the present invention will be described in detail with reference to the preferred embodiments. However, the following description represents typical examples of the embodiments of the present invention, and various changes and modifications can be made without departing from the intention and the scope of the present invention.

The present invention relates to a coating fluid for forming an undercoat layer of an electrophotographic photoreceptor, a method for producing the coating fluid, an electrophotographic photoreceptor comprising an undercoat layer formed by applying the coating fluid, an image forming apparatus using the electrophotographic photoreceptor, and an electrophotographic cartridge using the electrophotographic photoreceptor. The electrophotographic photoreceptor of the present invention comprises an electroconductive substrate, and an undercoat layer and a photosensitive layer formed on the substrate. The undercoat layer according to the present invention is provided between the electroconductive substrate and the photosensitive layer, has functions to improve adhesion between the electroconductive substrate and the photosensitive layer, to mask stain, scratches, etc. on the electroconductive substrate, to prevent carrier injection by heterogeneous surface properties or impurities, to reduce nonuniformity of electric characteristic, to prevent a decrease of the surface potential by repeated use, to prevent local fluctuations in surface potential which may cause image defects, etc., and is a layer not essential for development of photoelectric characteristics.

(Coating Fluid for Forming an Undercoat Layer)

The coating fluid for forming an undercoat layer of the present invention is used to form an undercoat layer and contains metal oxide agglomerated secondary particles having a volume average particle size of at most 0.1 μm and having a cumulative 90% particle size of at most 0.3 μm.

In the coating fluid for forming an undercoat layer of an electrophotographic photoreceptor of the present invention, primary particles of metal oxide particles are agglomerated to form agglomerated secondary particles. The volume average particle size and the cumulative 90% particle size of the metal oxide particles defined in the present invention are values regarding the agglomerated secondary particles. In a cumulative distribution curve with the total volume of particles being 100%, the particle size at a point of 50% in the cumulative distribution curve is taken as the volume average particle size (median diameter), and the particle size at a point of 90% in the cumulative distribution curve is taken as the cumulative 90% particle size. These values can be measured by a known method such as a weight sedimentation method or a light transmission particle size distribution measuring method. For example, they can be measured by a particle size analyzer (MicrotracUPA U150 (Model 9340), trade name, manufactured by NIKKISO CO., LTD.).

The light transmittance of the coating fluid for forming an undercoat layer of an electrophotographic photoreceptor of the present invention can be measured by a known spectrophotometer (absorption spectrophotometer). Since conditions at the time of measuring the light transmittance such as the cell size and the sample concentration vary depending upon physical properties of metal oxide particles used such as the particle size and the refractive index, usually the sample concentration is properly adjusted so as not to exceed the measurement limit of a detector in a wavelength range in which measurement is carried out (from 400 to 1,000 nm in the present invention). In the present invention, the sample concentration is adjusted so that the amount of metal oxide particles in the fluid is from 0.0075 wt % to 0.012 wt %. As a solvent to adjust the sample concentration, usually a solvent used as a solvent for the coating fluid for forming an undercoat layer is used, but any solvent may be used so long as it is compatible with the solvent and the binder resin for the coating fluid for forming an undercoat layer and will not make the mixture cloudy, and has no significant light absorption in a wavelength range of from 400 nm to 1,000 nm. More specifically, an alcohol such as methanol, ethanol, 1-propanol or 2-propanol, a hydrocarbon such as toluene, xylene or tetrahydrofuran, or a ketone such as methyl ethyl ketone or methyl isobutyl ketone may be used. Further, the cell for measurement is one having a cell size (optical path length) of 10 mm. The cell to be used may be any cell so long as it is substantially transparent in a range of from 400 nm to 1,000 nm, but preferred is use of quartz cells, and particularly preferred is use of matched cells with which the difference in transmittance characteristics between a sample cell and a standard cell is within a specific range.

(Metal Oxide Particles)

As the metal oxide particles in the present invention, any metal oxide particles which can be usually used for an electrophotographic photoreceptor may be used. More specifically, the metal oxide particles may, for example, be particles of a metal oxide containing at least one type of metal element selected from the group consisting of titanium oxide, aluminum oxide, silicon oxide, zirconium oxide, zinc oxide and iron oxide, or particles of a metal oxide containing a plurality of metal elements, such as calcium titanate, strontium titanate or barium titanate. Among them, preferred are metal oxide particles with a band gap of from 2 to 4 eV. Metal oxide particles of one type only may be used, or particles of plural types may be used as mixed. Among such metal oxide particles, titanium oxide, aluminum oxide, silicon oxide or zinc oxide is preferred, titanium oxide or aluminum oxide is more preferred and titanium oxide is particularly preferred.

The crystal form of the titanium oxide particles may be any of rutile, anatase, brookite and amorphous. Particles in a plurality of crystal states among those different crystal states may be contained.

The metal oxide particles may be subjected to various surface treatments. For example, they may be treated with an inorganic substance such as tin oxide, aluminum oxide, antimony oxide, zirconium oxide or silicon oxide, or an organic substance such as stearic acid, polyol or an organic silicon compound. Particularly when titanium oxide particles are used, they are preferably surface-treated with an organic silicon compound. The organic silicon compound may, for example, be usually a silicone oil such as dimethylpolysiloxane or methylhydrogenpolysiloxane, an organosilane such as methyldimethoxysilane or diphenyldimethoxysilane, a silazane such as hexamethyldisilazane, or a silane coupling agent such as vinyltrimethoxysilane, γ-mercaptopropyltrimethoxysilane or γ-aminopropyltriethoxysilane. Particularly, a silane treating agent represented by the following formula (1) has favorable reactivity with the metal oxide particles and is the best treating agent:

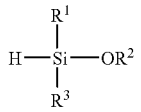

(1)

wherein each of $R^1$ and $R^2$ which are independent of each other, is an alkyl group, more specifically, a methyl group or an ethyl group, and $R^3$ is an alkyl group or an alkoxy group, more specifically, a group selected from a methyl group, an ethyl group, a methoxy group and an ethoxy group. Particles thus surface-treated have outermost surfaces treated with such a treating agent, but the particles may be treated with a treating agent such as aluminum oxide, silicon oxide or zirconium oxide prior to the above treatment. Titanium oxide particles of one type only may be used, or particles of plural types may be used as mixed.

The metal oxide particles used are usually ones having an average primary particle size of at most 500 nm, preferably from 1 nm to 100 nm, more preferably from 5 to 50 nm. The average primary particle size can be determined by the arithmetic mean of the sizes of particles directly observed by a transmission electron microscope (hereinafter sometimes referred to as TEM).

Further, the metal oxide particles used may have various refractive indices and are not limited so long as they can be usually used for an electrophotographic photoreceptor. Preferred are ones having a refractive index of at least 1.4 and at most 3.0. The refractive indices of metal oxide particles are disclosed in various publications, and they are as shown in the following Table 1 according to Filler Katsuyo Jiten (Filler dictionary, edited by Filler Society of Japan, TAISEISHA LTD., 1994) for example.

TABLE 1

| | Refractive index |
|---|---|
| Titanium oxide (rutile) | 2.76 |
| Lead titanate | 2.70 |
| Potassium titanate | 2.68 |
| Titanium oxide (anatase) | 2.52 |
| Zirconium oxide | 2.40 |
| Zinc sulfide | 2.37 to 2.43 |
| Zinc oxide | 2.01 to 2.03 |
| Magnesium oxide | 1.64 to 1.74 |
| Barium sulfate (precipitated) | 1.65 |
| Calcium sulfate | 1.57 to 1.61 |
| Aluminum oxide | 1.56 |
| Magnesium hydroxide | 1.54 |
| Calcium carbonate | 1.57 to 1.60 |
| Quartz glass | 1.46 |

Among the metal oxide particles in the present invention, specific commercial products of titanium oxide particles may, for example, be titanium oxide ultrafine particles not surface-treated "TTO-55(N)", titanium oxide ultrafine particles covered with $Al_2O_3$ "TTO-55(A)", "TTO-55(B)", titanium oxide ultrafine particles surface treated with stearic acid "TTO-55 (C)", titanium oxide ultrafine particles surface treated with $Al_2O_3$ and organosiloxane "TTO-55(S)", high purity titanium oxide "CR-EL", titanium oxide by sulfuric acid method "R-550", "R-580", "R-630", "R-670", "R-680", "R-780", "A-100", "A-220", "W-10", titanium oxide by chlorine method "CR-50", "CR-58", "CR-60", "CR-60-2", "CR-67", electrically conductive titanium oxide "SN-100P", "SN-100D", "ET-300 W" (each manufactured by ISHIHARA SANGYO KAISHA, LTD.). Further, titanium oxide such as "R-60", "A-110", "A-150", titanium oxide covered with $Al_2O_3$ "SR-1", "R-GL", "R-5N", "R-5N-2", "R-52N", "RK-1", "A-SP", titanium oxide covered with $SiO_2$ and $Al_2O_3$ "R-GX", "R-7E", titanium oxide covered with ZnO, $SiO_2$ and $Al_2O_3$ "R-650", titanium oxide covered with $ZrO_2$ and $Al_2O_3$ "R-61N" (each manufactured by Sakai Chemical Industry Co., Ltd.), titanium oxide surface treated with $SiO_2$ and $Al_2O_3$ "TR-700", titanium oxide surface treated with ZnO, $SiO_2$ and $Al_2O_3$ "TR-840", "TA-500", titanium oxide not surface-treated "TA-100", "TA-200", "TA-300", titanium oxide surface treated with $Al_2O_3$ "TA-400" (each manufactured by Fuji Titanium Industry Co., Ltd.), titanium oxide not surface-treated "MT-150 W", "MT-500B", titanium oxide surface treated with $SiO_2$ and $Al_2O_3$ "MT-100SA", "MT-500SA", and titanium oxide surface treated with $SiO_2$, $Al_2O_3$ and organosiloxane "MT-100SAS", "MT-500SAS" (each manufactured by Tayca Corporation) may, for example, be mentioned.

Further, as a specific trade name of aluminum oxide particles, "aluminum oxide C" (manufactured by NIPPON AEROSIL CO., LTD.) may, for example, be mentioned.

Further, as specific trade names of silicon oxide particles, "200CF" and "R972" (manufactured by NIPPON AEROSIL CO., LTD.) and "KEP-30" (manufactured by NIPPON SHOKUBAI CO., LTD.) may, for example, be mentioned.

Further, as a specific trade name of tin oxide particles, "SN-100P" (manufactured by ISHIHARA SANGYO KAISHA, LTD.) may, for example, be mentioned.

Further, as a specific trade name of zinc oxide particles, "MZ-305S" (manufactured by Tayca Corporation) may be mentioned. However, metal oxide particles which can be used in the present invention are not limited thereto.

In the coating fluid for forming an undercoat layer of an electrophotographic photoreceptor of the present invention, it is preferred to use the metal oxide particles in an amount of from 0.5 part by weight to 4 parts by weight per 1 part by weight of the binder resin.

In a case where the refractive index of the metal oxide particles is 2.0 or above, the amount is preferably from 1 part by weight to 4 parts by weight, particularly preferably from 2 parts by weight to 4 parts by weight. Further, in a case where the refractive index of the metal oxide particles is less than 2.0, the amount is preferably from 0.5 part by weight to 3 parts by weight, particularly preferably from 0.5 part by weight to 2.5 parts by weight.

(Binder Resin)

The binder resin used for the coating fluid for forming an undercoat layer of an electrophotographic photoreceptor of the present invention is not particularly limited so long as it is soluble in an organic solvent which is usually used for the coating fluid for forming an undercoat layer of an electrophotographic photoreceptor and the formed undercoat layer is insoluble in or is hardly soluble in and substantially immiscible with an organic solvent used for a coating fluid for forming a photosensitive layer.

As such a binder resin, a phenoxy resin, an epoxy resin, polyvinylpyrrolidone, polyvinyl alcohol, casein, polyacrylic acid, celluloses, gelatin, starch, polyurethane, polyimide or polyamide may, for example, be used alone or in a form cured together with a curing agent. Among them, a polyamide resin such as an alcohol-soluble copolymer polyamide or a modified polyamide is preferred, since it exhibits good dispersibility and coating property.

The polyamide resin may, for example, be a so-called copolymer nylon obtained by copolymerizing 6-nylon, 66-nylon, 610-nylon, 11-nylon, 12-nylon or the like, or an alcohol-soluble nylon resin having nylon chemically modified, such as N-alkoxymethyl-modified nylon or N-alkoxyethyl-modified nylon. As specific trade names, "CM4000", "CM8000" (each manufactured by Toray Industries, Inc.), "F-30K" "MF-30", "EF-30T" (each manufactured by Nagase ChemteX Corporation) may, for example, be mentioned.

Among these polyamide resins, a copolymer polyamide resin containing a diamine represented by the following formula (2) as a constituent can be particularly preferably used:

(2)

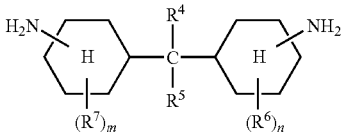

In the formula (2), each of $R^4$ to $R^7$ which are independent of one another, is a hydrogen atom or an organic substituent. Each of m and n which are independent of each other, is an integer of from 0 to 4, and when there are two or more substituents, these substituents may be different from each other. The organic substituent represented by each of $R^4$ to $R^7$ is preferably a hydrocarbon group having at most 20 carbon atoms, which may contain a hetero atom, more preferably an alkyl group such as a methyl group, an ethyl group, a n-propyl group or an isopropyl group; an alkoxy group such as a methoxy group, an ethoxy group, a n-propoxy group or an isopropoxy group; or an aryl group such as a phenyl group, a naphthyl group, an anthryl group or a pyrenyl group, more preferably an alkyl group or an alkoxy group, particularly preferably a methyl group or an ethyl group.

In addition, the copolymer polyamide resin containing a diamine represented by the above formula (2) as a constituent, may, for example, be a copolymer such as a bipolymer, a terpolymer or a tetrapolymer of a lactam such as γ-butyrolactam, ∈-caprolactam or lauryl lactam; a dicarboxylic acid such as 1,4-butanedicarboxylic acid, 1,12-dodecanedicarboxylic acid or 1,20-eicosanedicarboxylic acid; a diamine such as 1,4-butanediamine, 1,6-hexamethylenediamine, 1,8-octamethylenediamine or 1,12-dodecanediamine; piperazine, etc. in combination. The proportion in the copolymer is not particularly limited, but usually the proportion of the diamine component represented by the above formula (2) is from 5 to 40 mol %, preferably from 5 to 30 mol %. The number average molecular weight of the copolymer polyamide is preferably from 10,000 to 50,000, particularly preferably from 15,000 to 35,000. It is difficult to keep uniformity of the film either when the number average molecular weight is too low or too high. A method for producing the copolymer polyamide is not particularly limited, a conventional polycondensation method for a polyamide is properly applied, and melt polymerization, solution polymerization, interfacial polymerization or the like may be employed. Further, for polymerization, a monobasic acid such as acetic acid or benzoic acid, or a monoacid base such as hexylamine or aniline may be added as a molecular weight modifier without any problem.

Further, it is possible to add sodium phosphite, sodium hypophosphite, phosphorus acid, hypophosphorus acid, a thermal stabilizer represented by a hindered phenol, or other polymerization additives. Specific examples of the copolymer polyamide used in the present invention are shown below. In the specific examples, the proportion in the copolymer represents the proportion (mole fraction) of a monomer.

(Specific Examples of Polyamide)

(1)

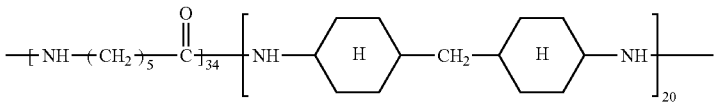

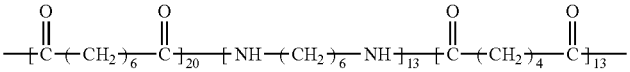

-continued (2)

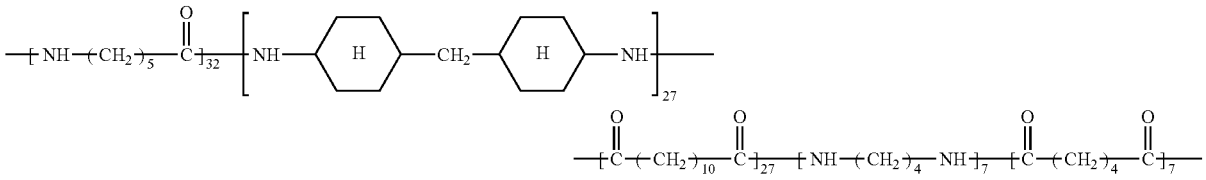

(3)

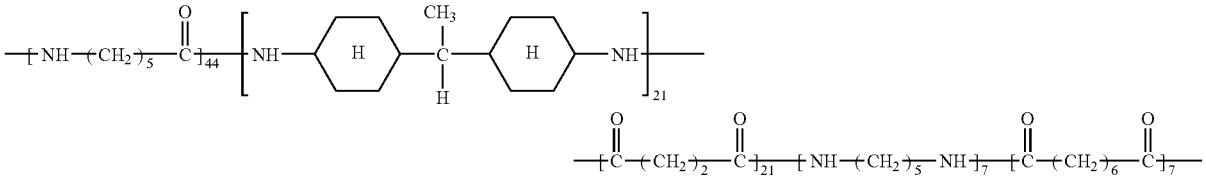

(4)

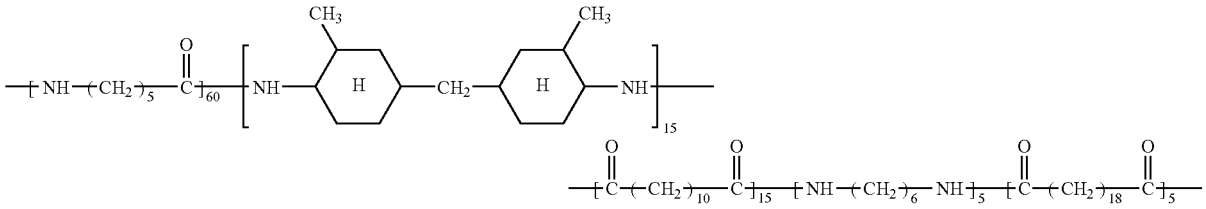

(5)

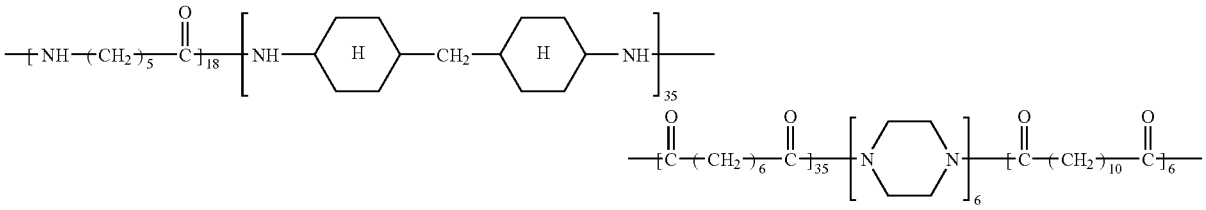

(6)

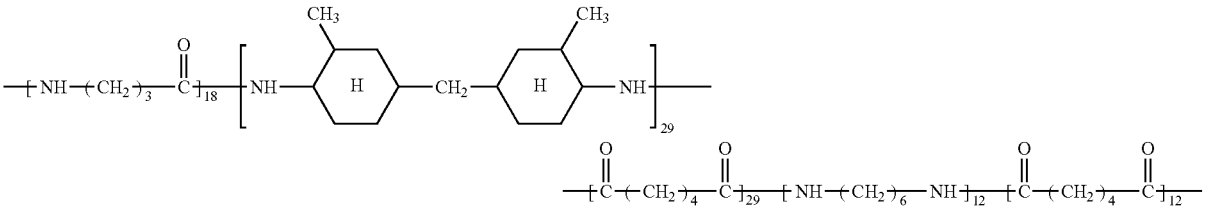

(7)

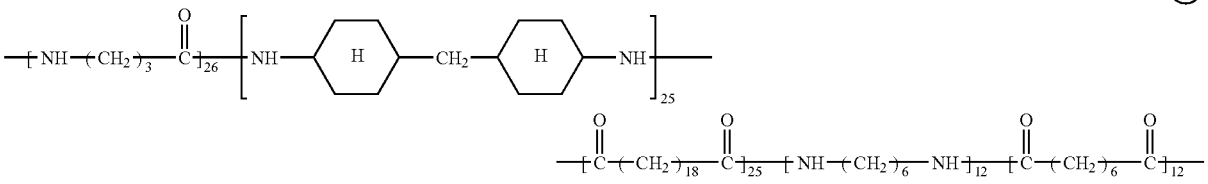

(Solvent Used for Coating Fluid for Forming an Undercoat Layer)

The organic solvent to be used for the coating fluid for forming an undercoat layer of the present invention may be any organic solvent so long as the binder resin for an undercoat layer of the present invention is dissolved in the solvent. Specifically, an alcohol having at most 5 carbon atoms such as methanol, ethanol, isopropyl alcohol or n-propyl alcohol; a halogenated hydrocarbon such as chloroform, 1,2-dichloroethane, dichloromethane, trichloroethylene, tetrachloromethane or 1,2-dichloropropane; a nitrogen-containing organic solvent such as dimethylformamide; or an aromatic hydrocarbon such as toluene or xylene may be mentioned, and a solvent mixture of them in an optional combination in an optional ratio may be used. Further, an organic solvent which does not dissolve the binder resin for an undercoat layer of the present invention by itself may be used if its solvent mixture with the above organic solvent can dissolve the binder resin. In general, unevenness of coating can be reduced by using a solvent mixture.

The ratio of the organic solvent to the solid content such as the binder resin and the titanium oxide particles used for the coating fluid for forming an undercoat layer of the present invention varies depending upon the method of applying the coating fluid for forming an undercoat layer and is properly changed so that a uniform coating film can be formed by the application method.

(Dispersing Method)

The coating fluid for forming an undercoat layer of the present invention contains metal oxide particles, and the metal oxide particles are present in the coating fluid as dispersed. To disperse the metal oxide particles in the coating fluid, they can be dispersed by wet dispersing in an organic solvent by a known mechanical grinding apparatus such as a ball mill, a sand grinding mill, a planetary mill or a roll mill, and preferred is dispersing utilizing a dispersing medium.

As a dispersing apparatus utilizing a dispersing medium, any known dispersing apparatus may be used, and a pebble mill, a ball mill, a sand mill, a screen mill, a gap mill, a vibration mill, a paint shaker or an attritor may, for example, be mentioned. Among them, preferred is one capable of dispersing the particles while circulating the coating fluid, and a sand mill, a screen mill or a gap mill is used in view of the dispersion efficiency, a fine ultimate particle size, easiness of continuous running, etc. The sand mill may be either vertical or horizontal. The shape of a disk in the sand mill is optional, e.g. a plate, a vertical pin or a horizontal pin.

Preferably a fluid circulating type sand mill is used, and particularly preferred is a wet grinding ball mill which comprises a cylindrical stator, a slurry feed opening provided on one end of the stator, a slurry outlet provide on the other end of the stator, a pin, disk or annular type rotor stirring and mixing a medium put in the stator and a slurry supplied through the feed opening, and an impeller type separator communicating with the outlet and rotating together with or separately from the rotor to separate the medium and the slurry by the action of centrifugal force and to discharge the slurry from the outlet, wherein a shaft center of a shaft rotating the separator is a hollow exhaust passage communicating with the outlet.

By using such a wet grinding ball mill, the slurry which is separated from the medium by the separator is discharged through the shaft center of the shaft, and the slurry is discharged in a state where it has no kinetic energy since no centrifugal force is applied at the shaft center. Therefore, no kinetic energy will be wasted, and thus no motive force will be consumed in vain.

Such a wet grinding ball mill may be horizontal, but is preferably vertical in order to increase the medium filling rate, and it is provided so that the outlet will be at the upper portion of the mill. Further, the separator is preferably provided at a portion higher than the level of the medium. In a case where the outlet is provided at the upper portion of the mill, the feed opening is provided at the bottom of the mill. According to a preferred embodiment, the feed opening comprises a valve seat and a V-shape, trapezoid or cone-shape valve capable of moving up and down to be fitted to the valve seat and capable of line contact with the edge of the valve seat, and it has a circular slit formed by the edge of the valve seat and the V-shape, trapezoid or cone-shape valve, through which the medium can not pass, to prevent the medium from falling down while letting the raw slurry be supplied. Further, it is possible to expand the slit by lifting up the valve thereby to discharge the medium, or to close the slit by getting the valve down thereby to seal the mill. Further, since the slit is formed by the valve and the edge of the valve seat, coarse particles in the raw slurry hardly enter the slit, and even if they enter the slit, they easily get away upward or downward, and thus clogging will hardly occur.

Further, by vibrating the valve up and down by a vibrating means, coarse particles which entered the slit can be removed from the slit and further, the entrance itself will hardly occur. In addition, a shearing force is applied to the raw slurry by vibration from the valve thereby to reduce the viscosity, and accordingly the amount of the raw slurry which passes through the slit i.e. the supply amount can be increased. The vibrating means to vibrate the valve may, for example, be a mechanical means such a vibrator, or a means to change the pressure of compressed air which affects a piston integrated with the valve, such as a reciprocating compressor or an electromagnetic switching valve switching the intake/exhaust of compressed air.

Such a wet grinding ball mill preferably has a screen to separate the medium and a product slurry outlet at its bottom in addition, so that the product slurry remaining in the mill is taken out after completion of the grinding.

The wet agitating ball mill according to the present invention is a vertical wet agitating ball mill comprising a cylindrical vertical stator, a product slurry feed opening provided at the bottom of the stator, a slurry outlet provided at the upper portion of the stator, a shaft supported at the upper portion of the stator and rotated by a driving means such as a motor, a pin, disk or annular type rotor fixed to the shaft, stirring and mixing a medium put in the stator and a slurry supplied through the feed opening, a separator provided near the outlet to separate the medium from the slurry, and a mechanical seal provided at a bearing supporting the shaft at the upper portion of the stator, wherein on the downside portion of a circular groove to which an O-ring in contact with a mating ring of the mechanical seal is fitted, a taper notch which extends downward is formed.

According to the wet agitating ball mill of the present invention, the mechanical seal is provided at a shaft center where the medium or the slurry has substantially no kinetic energy and at the upper portion of the stator which is higher than the level of the medium and the slurry, whereby entrance of the medium or the slurry into a space between the mating ring of the mechanical seal and the downside portion of the O-ring fitting groove can be significantly reduced.

In addition, the downside portion of the circular groove to which the O-ring is fitted, expands downward by the notch and has a clearance, whereby clogging caused by entrance of the slurry or the medium or by its solidification hardly occurs, the mating ring can smoothly follow the seal ring, and thus the function of the mechanical seal will be maintained. The downside portion of the fitting groove to which the O-ring is fitted has a V-shaped cross section, not that the entire groove is thin, and accordingly the strength will not be impaired, nor the O-ring holding function will not be impaired.

The wet grinding ball mill according to the present invention is also a wet grinding ball mill comprising a cylindrical stator, a slurry feed opening provided on one end of the stator, a slurry outlet provided on the other end of the stator, a pin, disk or annular type rotor stirring and mixing a medium put in the stator and a slurry supplied through the feed opening, and an impeller type separator communicating with the outlet and rotating together with or separately from the rotor to separate the medium and the slurry by the action of centrifugal force and to discharge the slurry from the outlet, wherein the separator comprising two disks having a fitting groove for a blade on the inner surfaces facing each other, a blade interposed between the disks fitted to the fitting groove, and a supporting means sandwiching the disks having the blade interposed therebetween, and in a preferred embodiment, the supporting means is composed of a step of a shaft constituting a stepped axis, and a cylindrical pressing means pressing the disks as fitted to the shaft, so that the disks having the blade interposed therebetween are sandwiched and supported by the step of the shaft and the pressing means.

Figure 3:
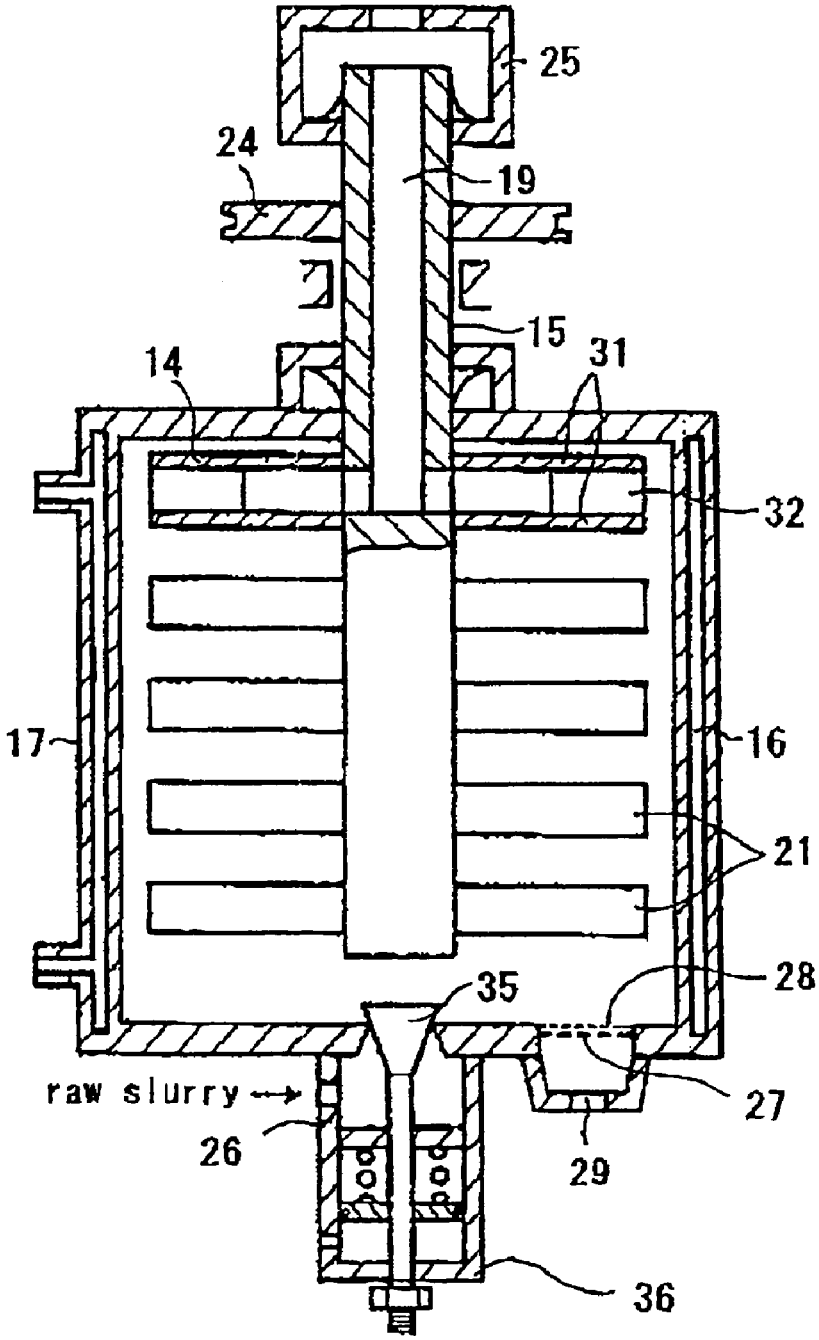
FIG. 3 is a vertical section illustrating a wet grinding ball mill according to the present invention.

FIG. 3 is a vertical section illustrating a wet grinding ball mill according to the present invention. In FIG. 3, a raw slurry is supplied to a vertical wet grinding ball mill and ground by being stirred together with a medium in the mill, separated from the medium by a separator 14 and discharged through a shaft center of a shaft 15 and returned. The raw slurry circulates and is ground through a series of these passages.

As shown in detail in FIG. 3, the vertical wet grinding ball mill is a vertical cylinder, and comprises a stator 17 provided with a jacket 16 through which cooling water cooling the mill flows, a shaft 15 located at the center of axis of the stator 17 and rotatably supported at the upper portion of the stator, having a mechanical seal in the bearing, and having a shaft center on the topside being a hollow exhaust passage 19, a pin- or disk-shape rotor 21 protruding toward the radius direction at the lower portion of the shaft, a pulley 24 fixed to the upper portion of the shaft and transmitting the driving force, a rotary joint 25 put on an open end at the top of the shaft, a separator 14 to separate the medium, fixed to the shaft 15 at a portion near the top in the stator, a raw slurry feed opening 26 provided opposing the end of the shaft 15 at the bottom of the stator, and a screen 28 to separate the medium, attached to a lattice-like screen supporter 27 provided on a raw slurry outlet 29 provided on an off-centered portion at the bottom of the stator. The separator 14 comprises a pair of disks 31 fixed to the shaft 15 with a certain distance, and a blade 32 connecting both the disks 31 to constitute an impeller, and rotates together with the shaft 15 to impart centrifugal force to the medium and the slurry entering a space between the disks thereby to send the medium outside into the radius direction by the difference in the specific gravity between them and to discharge the slurry through the exhaust passage 19 at the shaft center of the shaft 15. The raw slurry feed opening 26 comprises an inverted-trapezoid valve 35 capable of moving up and down to be fitted to a valve seat formed on the bottom of the stator, and a cylinder 36 with a bottom, protruding downward from the bottom of the stator. When the valve 35 is pushed up by the supply of the raw slurry, a circular slit is formed by the valve and the valve seat, through which the raw slurry is supplied into the mill.

The valve 35 when the raw slurry is supplied is elevated resistant to the pressure in the mill by the supply pressure of the raw slurry fed into the cylinder 36 thereby to form a slit with the valve seat.

In order to eliminate clogging in the slit, the valve 35 repeatedly reciprocates to move up to the upper limit with a short period thereby to eliminate the problem of entering. This reciprocation of the valve 35 may be conducted constantly, may be conducted in a case where the raw slurry contains coarse particles in a large amount, or may be conducted in association with the increase in the supply pressure of the raw slurry by clogging. A wet grinding ball mill having such a structure may, for example, be specifically ULTRA APEX MILL manufactured by KOTOBUKI INDUSTRIES CO., LTD.

Now, the method for grinding the raw slurry will be described below. The medium is put into the stator 17 of the ball mill, and while the rotor 21 and the separator 14 are driven and rotated by the external motive force, the raw slurry is fed to the feed opening 26 at a constant rate, and supplied into the mill through a slit formed between the edge of the valve seat and the valve 35.

The raw slurry and the medium in the mill are stirred and mixed by the rotation of the rotor 21 to grind the slurry. Further, by the rotation of the separator 14, the medium and the slurry entering a space in the separator are separated by the difference in the specific gravity so that a medium with a heavier specific gravity is sent outside into the radius direction, whereas the slurry with a lighter specific gravity is discharged through the exhaust passage 19 formed at the shaft center of the shaft 15 and returned to a raw slurry tank. At a stage where the grinding proceeds to a certain extent, the particle size of the slurry is properly measured, and when a desired particle size is achieved, the raw slurry pump is terminated once and then the operation of the mill is terminated to complete the grinding.

In a case where metal oxide particles are dispersed by using such a vertical wet grinding ball mill, grinding is carried out with a medium filling rate in the mill of preferably from 50 to 100%, more preferably from 70 to 95%, particularly preferably from 80 to 90%.

In the wet grinding ball mill applied for dispersion of the coating fluid for forming an undercoat layer of the present invention, the separator may have a screen or slit mechanism, but is preferably an impeller type and is preferably vertical. It is preferred that the wet grinding ball mill is vertically disposed and that the separator is provided at the upper portion of the mill. It is particularly preferred that the medium filling rate in the mill is set to from 80 to 90%, whereby grinding will be conducted most effectively and in addition, the separator can be located at a level higher than the level of the medium, such being effective to prevent the medium from being discharged by the separator.

The operating conditions of the wet grinding ball mill applied for dispersion of the coating fluid for forming an undercoat layer of the present invention have influences over the volume average particle size of metal oxide agglomerated secondary particles in the coating fluid for forming an undercoat layer, stability of the coating fluid for forming an undercoat layer, the surface state of an undercoat layer formed by applying the coating fluid, and properties of an electrophotographic photoreceptor having an undercoat layer formed by applying the coating fluid, and particularly the supply rate of the coating fluid for forming an undercoat layer and the speed of revolution of the rotor are mentioned as factors having significant influence.

The supply rate of the coating fluid for forming an undercoat layer depends on the volume and the shape of the mill, since the time over which the coating fluid for forming an undercoat layer stays in the mill is related with the supply rate, but in the case of a commonly used stator, it is preferably within a range of from 20 kg/hr to 80 kg/hr per 1 liter (hereinafter sometimes referred to as L) of the mill volume, more preferably from 30 kg/hr to 70 kg/hr per 1 L of the mill volume.

The speed of revolution of the rotor is influenced by parameters such as the shape of the rotor and a gap with the stator, and in the case of conventionally used stator and rotor, the circumferential speed at the tip of the rotor is preferably within a range of from 5 m/sec to 20 m/sec, more preferably from 8 m/sec to 15 m/sec, particularly preferably from 10 m/sec to 12 m/sec.

The dispersing medium is used in an amount of from 0.5 to 5 times the amount of the coating fluid for forming an undercoat layer by the volume ratio. In addition to the dispersing medium, a dispersing agent which can be easily removed after dispersing may be used in combination. The dispersing agent may, for example, be salt or salt cake.

The dispersion of metal oxide is carried out preferably wetly in the presence of a dispersing solvent, but the binder resin or various additives may be mixed simultaneously. Such a solvent is not particularly limited, but the above-described organic solvent used for the coating fluid for forming an undercoat layer is preferred, with which no step of exchanging the solvent or the like will be required after dispersing. The solvents may be used alone or in combination as a solvent mixture of two or more of them.

The amount of the solvent used is usually at least 0.1 part by weight, preferably at least 1 part by weight, and usually at most 500 parts by weight, preferably at most 100 parts by weight, per 1 part by weight of the metal oxide to be dispersed, from the viewpoint of productivity. As the temperature at the time of mechanical dispersing, dispersing can be conducted at a temperature of at least the freezing point and at most the boiling point of the solvent (or the solvent mixture), but it is carried out usually at least 10° C. and at most 200° C. in view of safety at the time of production.

After the dispersion treatment using a dispersing medium, the dispersing media is separated and removed, and ultrasonic treatment is preferably carried out. The ultrasonic treatment is to apply ultrasonic vibration to the coating fluid for forming an undercoat layer, and the oscillation frequency, etc. are not particularly limited, and ultrasonic vibration is applied usually by an oscillator at a frequency of from 10 kHz to 40 kHz, preferably from 15 kHz to 35 kHz.

The output of the ultrasonic oscillator is not particularly limited, but is usually from 100 W to 5 kW. Usually, a higher dispersion efficiency will be achieved when a small amount of the coating fluid is treated with ultrasonic waves by a low output ultrasonic oscillator than when a large amount of the coating fluid is treated with ultrasonic waves by a high output ultrasonic oscillator, and accordingly the amount of the coating fluid for forming an undercoat layer treated at a time is preferably from 1 to 50 L, more preferably from 5 to 30 L, particularly preferably from 10 to 20 L. Further, in such a case, the output of the ultrasonic oscillator is preferably from 200 W to 3 kW, more preferably from 300 W to 2 kW, particularly preferably from 500 W to 1.5 kW.

The method of applying ultrasonic vibration to the coating fluid for forming an undercoat layer is not particularly limited and may, for example, be a method of directly immersing an ultrasonic oscillator in a container in which the coating fluid for forming an undercoat layer is put, a method of bringing an ultrasonic oscillator into contact with the outer wall of a container in which the coating fluid for forming an undercoat layer is put, or a method of immersing a solution in which the coating fluid for forming an undercoat layer is put in a liquid to which vibration was applied by an ultrasonic oscillator. Among these methods, preferred is a method of immersing a solution in which the coating fluid for forming an undercoat layer is put in a liquid to which vibration was applied by an ultrasonic oscillator. In such a case, the liquid to which vibration is applied by an ultrasonic oscillator may, for example, be water; an alcohol such as methanol; an aromatic hydrocarbon such as toluene; or an oil such as silicone oil, and preferred is water considering the safety in production, the cost, cleanability, etc. In the method of immersing a solution in which the coating fluid for forming an undercoat layer in a liquid to which vibration was applied by an ultrasonic oscillator, the efficiency in the ultrasonic treatment varies depending upon the temperature of the liquid, and accordingly the temperature of the liquid is preferably kept constant. The temperature of the liquid to which vibration was applied may be increased by the ultrasonic vibration applied. The liquid is treated with ultrasonic waves within a temperature range of usually from 5 to 60° C., preferably from 10 to 50° C., more preferably from 15 to 40° C.

The container in which the coating fluid for forming an undercoat layer is put at the time of the ultrasonic treatment may be any container so long as it is usually used to put a coating fluid for forming an undercoat layer to be used for forming a photosensitive layer of an electrophotographic photoreceptor therein, and it may, for example, be a container made of a resin such as a polyethylene or a polypropylene, a glass container or a metal can. Among them, preferred is a metal can, particularly preferred is a 18 L metal can as stipulated in JIS Z 1602, which is hardly eroded by an organic solvent and is resistant to impact.

The coating fluid for forming an undercoat layer is filtered if desired to remove coarse particles and then used. In such a case, the medium for filtration may be any filter medium which is commonly used for filtration, such as cellulose fibers, resin fibers or glass fibers. As the form of the filter medium, preferred is a so-called wind filter comprising a core and fibers wound around the core, in view of a large filtration area and a high efficiency. The core may be any known core and may, for example, be a stainless steel core or a core made of a resin which is not soluble in the coating fluid for forming an undercoat layer such as a polypropylene.

The coating fluid for forming an undercoat layer thus prepared is used for formation of an undercoat layer after a binding agent or various assistants are further added thereto if desired.

(Dispersing Medium)

In the present invention, to disperse the titanium oxide particles in the coating fluid for forming an undercoat layer, a dispersing medium having an average particle size of from 5 μm to 200 μm is used.

Since the dispersing medium usually has a shape close to spheres, its average particle size can be determined by a method of screening with a sieve as stipulated in JIS Z 8801: 2000, etc. or by measurement by image analysis, and its density can be determined by Archimedes' principle. Specifically, for example, it is possible to measure the average particle size and sphericalness by an image processor represented by e.g. LUZEX50 manufactured by NIRECO CORPORATION. The average particle size of the dispersing medium is usually from 5 μm to 200 μm, particularly preferably from 10 μm to 100 μm. In general, a dispersing medium having a smaller particle size tends to provide a uniform dispersion liquid in a short time, but if the particle size is excessively small, the mass of the dispersing medium tends to be small, and dispersion with high efficiency will not be conducted.

The density of the dispersing medium is usually at least 5.5 $g/cm^3$, preferably at least 5.9 $g/cm^3$, more preferably at least 6.0 $g/cm^3$. In general, dispersion using a dispersing medium having a higher density tends to provide a uniform dispersion liquid in a short time. The sphericalness of the dispersing medium is preferably at most 1.08, and more preferably a dispersing medium having a sphericalness of at most 1.07 is used.

As the material of the dispersing medium, any known dispersing medium can be used so long as it is insoluble in the coating fluid for forming an undercoat layer and has a higher specific gravity than that of the coating fluid for forming an undercoat layer, and it is not reactive with the coating fluid for forming an undercoat layer nor denatures the coating fluid for forming an undercoat layer. It may, for example, be steel balls such as chrome balls (steel balls for ball bearings) or carbon balls (carbon steel balls); stainless balls; ceramic balls such as silicon nitride balls, silicon carbide balls, zirconia balls or alumina balls; or balls coated with a film of e.g. titanium carbonitride. Among them, preferred are ceramic balls, particularly preferred are zirconia fired balls. More specifically, it is particularly preferred to use zirconia fired beads as disclosed in Japanese Patent No. 3400836.

(Method for Forming Undercoat Layer)

The undercoat layer of the present invention is formed by applying the coating fluid for forming an undercoat layer on a substrate by a known coating method such as dip coating, spray coating, nozzle coating, spiral coating, ring coating, bar coating, roll coating or blade coating, followed by drying.

The spray coating may, for example, be air spraying, airless spraying, electrostatic air spraying, electrostatic airless spraying, rotary atomizing electrostatic spraying, hot spraying or hot airless spraying. Considering the atomization degree, the attaching efficiency, etc. to obtain a uniform film thickness, preferred is rotary atomizing electrostatic spraying by a transfer method as disclosed in JP-A-1-805198, that is, cylindrical works are continuously transferred without any space in the axis direction while being rotated, whereby an electrophotographic photoreceptor excellent in uniformity of the film thickness can be obtained with a high attaching efficiency overall.

The spiral coating may, for example, be a method of using an immersion coater or a curtain coater as disclosed in JP-A-52-119651, a method of continuously spraying the coating fluid streakily from a microaperture as disclosed in JP-A-1-231966, or a method of using a multi-nozzle as disclosed in JP-A-3-193161.

In the case of the immersion coating, the total solid content concentration in the coating fluid for forming an undercoat layer is usually at least 1 wt %, preferably at least 10 wt % and is usually at most 50 wt %, preferably at most 35 wt %, and the viscosity is preferably at least 0.1 cps, and preferably at most 100 cps.

Then, the coating film is dried, and the drying temperature and time are adjusted so that necessary and sufficient drying is carried out. The drying temperature is usually from 100 to 250° C., preferably from 110° C. to 170° C., more preferably from 115° C. to 140° C. As a drying method, hot air dryer, steam dryer, infrared dryer or far infrared dryer may be used.

(Electrophotographic Photoreceptor)

The electrophotographic photoreceptor of the present invention comprises an electroconductive substrate, and an undercoat layer and a photosensitive layer formed on the substrate, and the undercoat layer is provided between the electroconductive substrate and the photosensitive layer. The structure of the photosensitive layer may be any structure applicable to a known electrophotographic photoreceptor. Specifically, for example, a so-called monolayer type photoreceptor comprising a single photosensitive layer having a photoconductive material dissolved or dispersed in a binder resin; or a so-called lamination type photoreceptor having comprising a photosensitive layer consisting of a plurality of layers obtained by laminating a charge generation layer containing a charge generation material and a charge transport layer containing a charge transport material may, for example, be mentioned. It is generally known that a photoconductive material presents the same function either in the form of a monolayer type or a lamination type.

The photosensitive layer which the electrophotographic photoreceptor of the present invention has may be in any known form, but considering mechanical properties, electric properties and stability in production of the photoreceptor comprehensively, preferred is a lamination type photoreceptor, more preferred is an obverse lamination type photoreceptor having a charge generation layer and a charge transport layer laminated in this order on a photoconductive substrate.

(Electroconductive Substrate)

As the electroconductive substrate, a metallic material such as aluminum, aluminum alloy, stainless steel, copper or nickel, a resin material in which a conductive powder such as a metal, carbon or tin oxide has been added for ensuring an electroconductivity, a resin, glass, or paper with a conductive material such as aluminum, nickel or ITO (indium tin oxide alloy) deposited or coated on its surface, may, for example, be mainly used. They are used in drum form, sheet form, belt form, or the like. Alternatively, it may also be one obtained by applying a conductive material having an appropriate resistance value on an electroconductive substrate made of a metallic material for controlling the conductivity and the surface properties, or covering the defects.

When the metallic material such as an aluminum alloy is used as the electroconductive substrate, it may also be used after having undergone an anodic oxidation treatment. When it is subjected to the anodic oxidation treatment, it is desirably subjected to a sealing treatment by a known method.

For example, the anodic oxidation treatment in an acidic bath of e.g. chromic acid, sulfuric acid, oxalic acid, boric acid or sulfamic acid forms an anodic oxide film, and an anodic oxidation treatment in sulfuric acid provides more preferred results. In the case of the anodic oxidation treatment in sulfuric acid, it is preferred that the sulfuric acid concentration is from 100 to 300 g/L, the dissolved aluminum concentration is from 2 to 15 g/L, the liquid temperature is from 15 to 30° C., the electrolysis voltage is from 10 to 20 V, and the current density is from 0.5 to 2 A/dm$^2$. However, the conditions are not limited to the above conditions.

It is preferred to subject the anodic oxide film thus formed to a sealing treatment. The sealing treatment may be carried out by a known method, and for example, a low temperature sealing treatment of immersing the film in an aqueous solution containing nickel fluoride as the main component or a high temperature sealing treatment of immersing the film in an aqueous solution containing nickel acetate as the main component is preferably carried out.

In the case of the above low temperature sealing treatment, the concentration of the aqueous nickel fluoride solution used may optionally be selected, and more preferred results will be obtained when it is within a range of from 3 to 6 g/L. Further, in order to smoothly carry out the sealing treatment, the treatment temperature is usually at least 25° C., preferably at least 30° C., and usually at most 40° C., preferably at most 35° C., and the pH of the aqueous nickel fluoride solution is usually at least 4.5, preferably at least 5.5 and usually at most 6.5, preferably at most 6.0. As a pH adjustor, oxalic acid, boric acid, formic acid, acetic acid, sodium hydroxide, sodium acetate, ammonium water or the like may be used. The treatment time is preferably from 1 to 3 minutes per 1 μm thickness of the film. Further, in order to further improve film physical properties, cobalt fluoride, cobalt acetate, nickel sulfate, a surfactant or the like may be preliminarily added to the aqueous nickel fluoride solution. Then, washing with water and drying are carried out to complete the low temperature sealing treatment. In the case of the high temperature sealing treatment, as a sealing agent, an aqueous solution of a metal salt such as nickel acetate, cobalt acetate, lead acetate, nickel-cobalt acetate or barium nitrate may be used, and it is particularly preferred to use nickel acetate. In the case of using an aqueous nickel acetate solution, the concentration is preferably within a range of from 5 to 20 g/L. It is preferred to carry out the treatment at a treatment temperature of usually at least 80° C., preferably at least 90° C. and usually at most 100° C., preferably at most 98° C., at a pH of the aqueous nickel acetate solution of from 5.0 to 6.0. Here, as a pH adjustor, ammonia water, sodium acetate or the like may be used. The treatment time is at least 10 minutes, preferably at least 15 minutes. In this case also, in order to improve the film physical properties, sodium acetate, an organic carboxylic acid, an anionic or nonionic surfactant or the like may be added to the aqueous nickel acetate solution. Further, treatment with hot water or hot water vapor containing substantially no salt may be carried out. Then, washing with water and drying are carried out to complete the high temperature sealing treatment. In a case where the average film thickness of the anodic oxide film is thick, stronger sealing conditions such as a high concentration of the sealing liquid and a treatment at a higher temperature for a longer time are required. Thus, not only the productivity tends to be poor but also surface defects such as stain, dirt or dust attachment are likely to occur. From such a viewpoint, the average film thickness of the anode oxide film is usually preferably at most 20 μm, particularly preferably at most 7 μm.

The substrate surface may be either smooth, or roughened by using a particular cutting method or carrying out a polishing treatment. Further, it may also be the one roughened by mixing particles with an appropriate particle size in the material constituting the substrate. Further, to lower the cost, a drawn tube without cutting treatment may be used as it is. Particularly, it is preferred to use a non-cut aluminum substrate obtained by drawing, impact extrusion, ironing or the like, since attachments such as stain or foreign matters, small scratches, etc. on the surface are eliminated by the treatment, and a uniform and clean substrate will be obtained.

(Undercoat Layer)

The film thickness of the undercoat layer is optional, but with a view to improving properties of the photoreceptor and the coating properties, it is usually preferably at least 0.1 μm and at most 20 μm. Further, to the undercoat layer, a known antioxidant, etc. may be added.

The surface state of the undercoat layer of the present invention is characterized by the in-plane root mean square roughness (RMS), the in-plane arithmetic mean roughness (Ra) and the in-plane maximum roughness (P-V), and these values are values having reference lengths i.e. the root mean square height, the arithmetic mean height and the maximum height as stipulated in JIS B 0601:2001 extended to the reference plane. Using Z(x) which is a value in a height direction in the reference plane, the in-plane root mean square roughness (RMS) represents the root mean square value of Z(x), the in-plane arithmetic mean roughness (Ra) represents the average of absolute values of Z(x), and the in-plane maximum roughness (P-V) represents the sum of the maximum height of the peak and the maximum depth of the valley. The in-plane root mean square roughness (RMS) of the undercoat layer of the present invention is usually from 10 to 100 nm, preferably from 20 to 50 nm. The in-plane arithmetic mean roughness (Ra) of the undercoat layer of the present invention is usually from 10 to 50 nm, preferably from 10 to 50 nm. Further, the in-plane maximum roughness (P-V) of the undercoat layer of the present invention is usually from 100 to 1,000 nm, preferably from 300 to 800 nm.

These values regarding the surface state may be measured by any surface shape analyzer so long as irregularities in the reference plane can be measured with high precision. Particularly, it is preferred to measure these values by a method of detecting irregularities on the sample surface by combining high precision phase shift detection method and order counting of interference fringes using an optical interferometer. More specifically, they are measured preferably by using Micromap manufactured by Ryoka Systems Inc., by the interference fringe addressing method at wave mode.

The undercoat layer of the electrophotographic photoreceptor of the present invention is such that when it is dispersed in a solvent capable of dissolving the binder resin binding the undercoat layer to prepare a dispersion liquid, the dispersion liquid presents a specific light transmittance. The light transmittance in this case also can be measured in the same manner as measuring the light transmittance of the coating fluid for forming an undercoat layer of an electrophotographic photoreceptor of the present invention.

When the undercoat layer of the present invention is dispersed to prepare a dispersion liquid, the layer on the undercoat layer is dissolved and removed in a solvent substantially incapable of dissolving the binder resin binding the undercoat layer and capable of dissolving the photosensitive layer, etc. formed on the undercoat layer, then the binder resin binding the undercoat layer is dissolved in a solvent to prepare a dispersion liquid, and the solvent in this case may be any solvent presenting no significant light absorption in a wavelength range of from 400 nm to 1,000 nm. More specifically, an alcohol such as methanol, ethanol, 1-propanol or 2-propanol is used, and particularly methanol, ethanol and/or 1-propanol is used.

With respect to a dispersion liquid obtained by dispersing the undercoat layer of the present invention in a solvent mixture of methanol and 1-propanol in a weight ratio of 7:3, the difference between the absorbance to a light having a wavelength of 400 nm to the absorbance to a light having a wavelength of 1,000 nm, is at most 0.3 (Abs) in a case where the refractive index of the metal oxide particles is at least 2.0, or at most 0.02 (Abs) in a case where the refractive index of the metal oxide particles is at most 2.0. More preferably, it is at most 0.2 (Abs) in a case where the refractive index of the metal oxide particles is at least 2.0, and at most 0.01 (Abs) in a case where the refractive index of the metal oxide particles is at most 2.0. The absorbance depends on the solid content concentration of the fluid to be measured, and accordingly in the present invention, the undercoat layer is preferably dispersed so that the metal oxide concentration in the dispersion liquid is within a range of from 0.003 wt % to 0.0075 wt %.

The specular reflectance of the undercoat layer which the electrophotographic photoreceptor of the present invention has is a value specific to the present invention. The specular reflectance of the undercoat layer in the present invention is the specular reflectance of the undercoat layer on the electroconductive substrate relative to the electroconductive substrate, and since the reflectance varies depending upon the film thickness of the undercoat layer, in the present invention, the reflectance is defined as a reflectance when the undercoat layer is 2 μm.

Of the undercoat layer of the electrophotographic photoreceptor of the present invention, in a case where the refractive index of the metal oxide particles which the undercoat layer contains is at least 2.0, the ratio of the specular reflection of the undercoat layer calculated as a thickness of 2 μm to a light having a wavelength of 480 nm, to the specular reflection of the electroconductive substrate to a light having a wavelength of 480 nm, is at least 50%; and in a case where the refractive index of the metal oxide particles is at most 2.0, the ratio of the specular reflection of the undercoat layer calculated as a thickness of 2 μm to a light having a wavelength of 400 nm, to specular reflection of the electroconductive substrate to a light having a wavelength of 400 nm, is at least 50%. Either in a case where the undercoat layer contains a plural types of metal oxide particles having a refractive index of at least 2.0 and in a case where it contains a plural types of metal oxide particles having a refractive index of at most 2.0, the specular reflection is preferably as defined above. Further, in a case where the undercoat layer contains metal oxide particles having a refractive index of at least 2.0 and metal oxide particles having a refractive index of at most 2.0 simultaneously, in the same manner as a case where it contains metal oxide particles having a refractive index of at least 2.0, the ratio of the specular reflection of the undercoat layer calculated as a thickness of 2 μm to a light having a wavelength of 480 nm, to the specular reflection of the electroconductive substrate to a light having a wavelength of 480 nm, is preferably at least 50%.

Further, in the electrophotographic photoreceptor of the present invention, the film thickness of the undercoat layer is not limited to 2 μm and is optional. In a case where the film thickness of the undercoat layer is not 2 μm, using the coating fluid for forming an undercoat layer used for formation of the undercoat layer of the electrophotographic photoreceptor, an undercoat layer having a film thickness of 2 μm is formed by applying the coating fluid on the same electroconductive substrate as that used for the electrophotographic photoreceptor, and then the specular reflectance of the obtained undercoat layer is measured. Otherwise, as another method, the specular reflectance of the undercoat layer of the electrophotographic photoreceptor is measured, which is calculated as a case where the film thickness is 2 μm.

Now, the calculation method will be described below.

In a case where a monochromatic light specific to the present invention passes through the undercoat layer, is specularly reflected on the electroconductive substrate, and passes through the undercoat layer again and then detected, a thin layer with a thickness dL perpendicular to the light is assumed.

The loss −dI of the intensity of the light after it passed through dL is considered to be in proportion with dL and the intensity I of the light before it passed through the layer, and is expressed by the following formula (k is a constant):

$$-dI=kIdL \tag{1}$$

The formula (1) is modified as follows:

$$-dI/I=kdL \tag{2}$$

Both sides of the formula (2) are integrated between 0 and L from $I_0$ to I, thereby to obtain the following formula:

$$\log(I_o/I)=kL \tag{3}$$

This is the same as one called Lambert's Law in a solution system and can be applied to measurement of the reflectance in the present invention.

The formula (3) is modified to obtain $$I=I_0\exp(-kL) \tag{4}$$

and the behavior until the incident light reaches the surface of the electroconductive substrate is represented by the formula (4).

Further, since the denominator of the specular reflectance in the present invention is the light after the incident light is reflected on the electroconductive substrate, the reflectance $R=I_1/I_0$ on the surface of a cylinder is considered.

The light which reached the surface of the electroconductive substrate in accordance with the formula (4) is specularly reflected after being multiplied by the reflectance R and then passes through the optical path length L again and goes out to the surface of the undercoat layer. Namely, the following formula is obtained:

$$I=I_0\exp(-kL)\cdot R\cdot\exp(-kL) \tag{5}$$

$R=I_1/I_0$ is assigned and the formula is further modified to obtain a relational expression:

$$I/I_1=\exp(-2kL) \tag{6}$$

This is a value of the reflectance of the undercoat layer relative to the reflectance of the electroconductive substrate and is defined as the specular reflectance.

As described above, the optical path length is 4 μm there and back in the case of a 2 μm undercoat layer, and the reflectance T of the undercoat layer on an optional electroconductive substrate is a function of the film thickness L of the undercoat layer (in this case, the optical path length is 2 L) and is represented by T(L). From the formula (6):

$$T(L)=I/I_1=\exp(-2kL) \tag{7}$$

Further, since the value which should be known is T(2), L=2 is assigned to the formula (4) to obtain:

$$T(2)=I/I_1=\exp(-4k) \tag{8}$$

and k is deleted by the formulae (4) and (5) to obtain:

$$T(2)=T(L)^2/L \tag{9}$$

That is, when the film thickness of the undercoat layer is L (μm), the reflectance T(2) in a case where the undercoat layer is 2 μm can be estimated with considerable accuracy by measuring the reflectance T(L) of the undercoat layer. The film thickness L of the undercoat layer can be measured by an optional film thickness measuring apparatus such as a roughness meter.

(Charge Generation Material)

A charge generation material to be used for an electrophotographic photoreceptor in the present invention may be any material which has been proposed for this application. Such a material may, for example, be an azo type pigment, a phthalocyanine type pigment, an anthanthrone type pigment, a quinacridone type pigment, a cyanine type pigment, a pyrylium type pigment, a thiapyrylium type pigment, an indigo type pigment, a polycyclic quinone type pigment or a squalic acid type pigment. Particularly preferred is a phthalocyanine pigment or an azo pigment. A phthalocyanine pigment is excellent with a view to obtaining a highly sensitive photoreceptor to a laser beam having a relatively long wavelength and an azo pigment is excellent with a view to having sufficient sensitivity to white light and a laser beam having a relatively short wavelength.

In the present invention, a high effect will be obtained when a phthalocyanine type compound is used as the charge generation material. Specifically, the phthalocyanine type compound may, for example, be metal-free phthalocyanine, phthalocyanines in which metals such as copper, indium, gallium, tin, titanium, zinc, vanadium, silicon and germanium, or oxides thereof, halides thereof, hydroxides thereof, alkoxides thereof, or the like are coordinated, and their various crystal forms. Particularly, high-sensitivity X-form, τ-form metal-free phthalocyanines, A-form (alias β-form), B-form (alias α-form), D-form (alias Y-form) or the like of titanyl phthalocyanine (alias oxytitanium phthalocyanine), vanadyl phthalocyanine, chloroindium phthalocyanine, II-type or the like of chlorogallium phthalocyanine, V-type or the like of hydroxygallium phthalocyanine, G-type, I-type or the like of μ-oxo-gallium phthalocyanine dimer, or II-type or the like of μ-oxo-aluminium phthalocyanine dimer are preferred. Among these phthalocyanines, particularly preferred are A-form (β-form), B-form (α-form) and D-form (Y-form) titanyl phthalocyanine, II-form chlorogallium phthalocyanine, V-form hydroxygallium phthalocyanine, and G-form μ-oxo-gallium phthalocyanine dimer. Further, among these phthalocyanine type compounds, preferred are oxytitanium phthalocyanine showing a chief diffraction peak at Bragg angle (2θ±0.2°) of 27.3° in X-ray diffraction spectrum to CuKα characteristic X-ray, oxytitanium phthalocyanine showing chief diffraction peaks at 9.3°, 13.2°, 26.2° and 27.1°, dihydroxysilicon phthalocyanine showing chief diffraction peaks at 9.2°, 14.1°, 15.3°, 19.7° and 27.1°, dichlorotin phthalocyanine showing chief diffraction peaks at 8.5°, 12.2°, 13.8°, 16.9°, 22.4°, 28.4° and 30.1°, hydroxypotassium phthalocyanine showing chief diffraction peaks at 7.5°, 9.9°, 12.5°, 16.3°, 18.6°, 25.1° and 28.3°, and chlorogallium phthalocyanine showing diffraction peaks at 7.4°, 16.6°, 25.5° and 28.3°. Among them, particularly preferred is oxytitanium phthalocyanine showing a chief diffraction peak at 27.3°, and in such as case, especially preferred is oxytitanium phthalocyanine showing chief diffraction peaks at 9.5°, 24.1° and 27.3°.

The phthalocyanine type compounds may be used singly or in a mixture or in a mixed crystal of some thereof. The phthalocyanine type compounds in a mixture or in a mixed crystal state may be obtained by mixing respective constituents afterwards, or by causing the mixed state in the manufacturing and treatment process of the phthalocyanine type compounds, such as preparation, formation into pigment or crystallization. As such treatment, an acid paste treatment, a grinding treatment, a solvent treatment or the like is known. To cause a mixed crystal state, a method may be known comprising mixing two type of crystals, mechanically grinding the mixture into an undefined form, and then converting the mixture to a specific crystal state by a solvent treatment, as disclosed in JP-A-10-48859.

Further, in the case of using a phthalocyanine type compound, a charge generation material other than the phthalocyanine type compound may be used in combination. For example, an azo pigment, a perylene pigment, a quinacridone pigment, a polycyclic quinone pigment, an indigo pigment, a benzimidazole pigment, a pyrylium salt, a thiapyrylium salt, a squalilium salt or the like may be used as mixed.

The charge generation material is dispersed in the coating fluid for forming a photosensitive layer, and it may preliminarily be pre-pulverized before dispersed in the coating fluid. The pre-pulverization may be carried out by various apparatuses, but is usually carried out by using a ball mill, a sand grinding mill or the like. The pulverizing medium to be charged into such as pulverizing apparatus may be any medium so long as it will not be powdered in the pulverization treatment and it can easily be separated after the dispersion treatment, and beads or balls of e.g. glass, alumina, zirconia, stainless steel or a ceramic may be mentioned. In the pre-pulverization, the charge generation material is pulverized to a volume average particle size of preferably at most 500 μm, more preferably at most 250 μm. The volume average particle size may be measured by any method which one skilled in the art usually employs, but is measured usually by a sedimentation method or a centrifugal sedimentation method.

(Charge Transport Material)

The charge transport material may, for example, be a polymer compound such as polyvinyl carbazole, polyvinylpyrene, polyglycidyl carbazole or polyacenaphthylene; a polycyclic aromatic compound such as pyrene or anthracene; a heterocyclic compound such as an indole derivative, an imidazole derivative, a carbazole derivative, a pyrazole derivative, a pyrazoline derivative, an oxadiazole derivative, an oxazole derivative or a thiadiazole derivative; a hydrazone type compound such as p-diethylaminobenzaldehyde-N,N-diphenylhydrazone or N-methylcarbazole-3-carbaldehyde-N,N-diphenylhydrazone; a styryl type compound such as 5-(4-(di-p-tolylamino)benzylidene-5H-dibenzo(a,d)cycloheptene; a triarylamine type compound such as p-tritolylamine; a benzidine type compound such as N,N,N',N'-tetraphenylbenzidine; a butadiene type compound; or a triphenylmethane type compound such as di-(p-ditolylaminophenyl)methane. Among them, preferred is a hydrazone derivative, a carbazole derivative, a styryl type compound, a butadiene type compound, a triarylamine type compound or a benzidine type compound, or a combination thereof. These charge transport materials may be used alone or as a mixture of some of them.

(Binder Resin for Photosensitive Layer)

The photosensitive layer of the electrophotographic photoreceptor of the present invention is formed by binding the photoconductive material with a binder resin. The binder resin may be any known binder resin which can be used for the electrophotographic photoreceptor, and specifically, it may, for example, be a vinyl polymer such as polymethyl methacrylate, polystyrene, polyvinyl acetate, polyacrylic ester, polymethacrylic ester, polyester, polyallylate, polycarbonate, polyester polycarbonate, polyvinyl acetal, polyvinyl acetoacetal, polyvinyl propional, polyvinyl butyral, polysulfone, polyimide, a phenoxy resin, an epoxy resin, a urethane resin, a silicone resin, cellulose ester, cellulose ether, a vinyl chloride/vinyl acetate copolymer or polyvinyl chloride, or a copolymer thereof. A partially crosslinked cured produced thereof may also be used.

(Layer Containing Charge Generation Layer)

Lamination Type Photoreceptor

In a case where the photoreceptor is a so-called lamination type photoreceptor, the layer containing the charge generation material is usually a charge generation layer, but the charge generation material may be contained in the charge transport layer. In a case where the layer containing the charge generation material is a charge generation layer, the amount of the charge generation material is usually from 30 to 500 parts by weight, more preferably from 50 to 300 parts by weight per 100 parts by weight of the binder resin contained in the charge generation layer. If the amount is too small, electric characteristics of the electrophotographic photoreceptor tend to be insufficient, and if the amount is too small, stability of the coating fluid will be impaired. The volume average particle size of the charge generation material in the layer containing the charge generation material is preferably at most 1 μm, more preferably at most 0.5 μm. The film thickness of the charge generation layer is usually from 0.1 μm to 2 μm, preferably from 0.15 μm to 0.8 μm. The charge generation layer may contain a known plasticizer for improving the film-forming properties, flexibility, mechanical strength, etc., an additive for controlling the residual potential, a dispersant aid for improving the dispersion stability, a leveling agent for improving the coating properties, a surfactant, a silicone oil, a fluorine-based oil and other additives.

Monolayer Type Photoreceptor

In a case where the photoreceptor is a so-called monolayer type photoreceptor, the above charge generation material is dispersed in a matrix containing the binder rein and the charge transport material as the main components in the same blend ratio as that of the after-mentioned charge transport layer. The particle size of the charge generation material in such a case is required to be sufficiently small, and it is preferably 1 μm or less, more preferably 0.5 μm or less by the volume average particle size.

If the amount of the charge generation material to be dispersed in the photosensitive layer is too small, sufficient sensitivity can not be obtained. Whereas, if it is too much, there occur detrimental effects such as a reduction in the triboelectricity, a reduction in the sensitivity, and the like. Accordingly, the charge generation material is used preferably in a range of from 0.5 to 50 wt %, more preferably in a range of from 10 to 45 wt %. The film thickness of the photosensitive layer to be used is usually from 5 to 50 μm, preferably from 10 to 45 μm. The photosensitive layer of a monolayer type photoreceptor may also contain a known plasticizer for improving the film-forming properties, flexibility, mechanical strength, etc., an additive for controlling the residual potential, a dispersant aid for improving the dispersion stability, a leveling agent for improving the coating properties, a surfactant, a silicone oil, a fluorine-based oil, and other additives.

(Layer Containing Charge Transport Material)

In the case of a lamination type photoreceptor, the charge generation layer may be formed by a resin having a charge transport function itself, but preferred is a structure such that the above charge transport material is dispersed or dissolved in the binder resin. Further, in the case of a monolayer type photoreceptor, such a structure is employed that the charge transport material is dispersed or dissolved in the binder resin as a matrix in which the charge generation material is to be dispersed.

The binder resin to be used for the layer containing the charge transport material may, for example, be a vinyl polymer such as polymethyl methacrylate, polystyrene or polyvinyl chloride, or a copolymer thereof, or a polycarbonate, polyallylate, polyester, polyester carbonate, polysulfone, polyimide, phenoxy, epoxy or silicone resin, and a partially crosslinked cured product thereof may also be used.

Further, the layer containing the charge transport material may contain various additives if desired such as an antioxidant such as a hindered phenol or a hindered amine, an ultraviolet absorber, a sensitizer, a leveling agent and an electron-withdrawing substance. The film thickness of the layer containing the charge transport material is usually from 5 to 60 μm, preferably from 10 to 45 μm, more preferably from 15 to 27 μm.

As the ratio of the binder resin to the charge transport material, the charge transport material is used in an amount of usually from 20 to 200 parts by weight, preferably from 30 to 150 parts by weight, more preferably from 40 to 120 parts by weight, per 100 parts by weight of the binder resin.

(Surface Layer)

As the outermost layer, for example, a known surface protective layer or overcoat layer containing a thermoplastic or thermosetting polymer as the main component may be provided.

(Layer Forming Method)

The respective layers of the photosensitive layer are sequentially formed by applying a coating fluid obtained by dissolving or dispersing a material to be contained in each layer in a solvent, such as the coating fluid for forming an undercoat layer of the present invention, by a known method such as dip coating, spray coating or ring coating. In such a case, the coating fluid may contain various additives such as a leveling agent for improving the coating property, an antioxidant and a sensitizer if desired.

(Organic Solvent)

The organic solvent to be used for the coating fluid may be any solvent which can be used for the above-described wet mechanical dispersing. Preferably, it may, for example, be an alcohol such as methanol, ethanol, propanol, cyclohexanone, 1-hexanol or 1,3-butanediol; a ketone such as acetone, methyl ethyl ketone, methyl isobutyl ketone or cyclohexanone; an ether such as dioxane, tetrahydrofuran or ethylene glycol monomethyl ether; an ether ketone such as 4-methoxy-4-methyl-2-pentanone; a (halo)aromatic hydrocarbon such as benzene, toluene, xylene or chlorobenzene; an ester such as methyl acetate or ethyl acetate; an amide such as N,N-dimethylformamide or N,N-dimethylacetamide; or a sulfoxide such as dimethyl sulfoxide. Among these solvents, particularly preferred is an alcohol, an aromatic hydrocarbon or an ether ketone. More preferred is toluene, xylene, 1-hexanol, 1,3-butanediol, 4-methoxy-4-methyl-2-pentanone or the like.

Among them, at least one solvent is used, or two or more among these solvents may be used as mixed. As a solvent to be mixed is preferably an ether, an alcohol, an amide, a sulfoxide, an ether ketone, an amide, a sulfoxide or an ether ketone, and among them, an ether such as 1,2-dimethoxyethane or an alcohol such as 1-propanol is suitable. Particularly suitably, an ether is mixed, particularly when oxytitanium phthalocyanine is used as the charge generation material to prepare a coating fluid, with a view to crystal form stability of the phthalocyanine, dispersion stability, etc.

(Image Forming Apparatus)

Now, the embodiment of an image forming apparatus employing the electrophotographic photoreceptor of the present invention will be explained with reference to FIG. 1 illustrating a structure of a substantial part of the apparatus. However, the embodiment is not limited to the following explanation, and various changes and modifications can be made without departing from the spirit and scope of the present invention.

As shown in FIG. 1, the image forming apparatus comprises an electrophotographic photoreceptor 1, a charging apparatus 2, an exposure apparatus 3 and a developing apparatus 4, and it further has a transfer apparatus 5, a cleaning apparatus 6 and a fixing apparatus 7 as the case requires.

The electrophotographic photoreceptor 1 is not particularly limited so long as it is the above-described electrophotographic photoreceptor of the present invention, and in FIG. 1, as one example thereof, a drum form photoreceptor comprising a cylindrical electroconductive substrate and the above-described photosensitive layer formed on the surface of the substrate. Along the outer peripheral surface of the electrophotographic photoreceptor 1, the charging apparatus 2, the exposure apparatus 3, the developing apparatus 4, the transfer apparatus 5 and the cleaning apparatus 6 are disposed.

The charging apparatus 2 is to charge the electrophotographic photoreceptor 1, and uniformly charges the surface of the electrophotographic photoreceptor 1 to a predetermined potential. In FIG. 1, as one example of the charging apparatus 2, a roller type charging apparatus (charging roller) is shown, and in addition, a corona charging apparatus such as corotron or scorotron, a contact charging apparatus such as a charging brush, and the like are popularly used.

The electrophotographic photoreceptor 1 and the charging apparatus 2 are designed to be removable from the main body of the image forming apparatus, in the form of a cartridge comprising both (hereinafter sometimes referred to as a photoreceptor cartridge) in many cases. And when the electrophotographic photoreceptor 1 or the charging apparatus 2 is deteriorated for example, the photoreceptor cartridge can be taken out from the main body of the image forming apparatus and another new photoreceptor cartridge can be attached to the main body of the image forming apparatus. Further, the toner as described hereinafter is stored in a toner cartridge and is designed to be removable from the main body of the image forming apparatus in many cases, and when the toner in the toner cartridge used is consumed, the toner cartridge can be taken out from the main body of the image forming apparatus, and another new toner cartridge can be attached. Further, a cartridge comprising all the electrophotographic photoreceptor 1, the charging apparatus 2 and the toner may be used in some cases.

The type of the exposure apparatus 3 is not particularly limited so long as the electrophotographic photoreceptor 1 is exposed to form an electrostatic latent image on the photosensitive surface of the electrophotographic photoreceptor 1. Specific examples thereof include a halogen lamp, a fluorescent lamp, a laser such as a semiconductor laser or a He—Ne laser and LED. Further, exposure may be carried out by a photoreceptor internal exposure method. The light for the exposure is optional, and exposure may be carried out with a monochromatic light having a wavelength of 780 nm, a monochromatic light slightly leaning to short wavelength side having a wavelength of from 600 nm to 700 nm, a short wavelength monochromatic light having a wavelength of from 380 nm to 600 nm or the like. Particularly, exposure is carried out preferably with a monochromatic light having a short wavelength of from 380 to 600 nm, more preferably with a monochromatic light having a wavelength of from 380 nm to 500 nm.

The type of the developing apparatus 4 is not particularly limited, and an optional apparatus of e.g. a dry development method such as cascade development, single component conductive toner development or two component magnetic brush development or a wet development method may be used. In FIG. 1, the developing apparatus 4 comprises a developing tank 41, an agitator 42, a supply roller 43, a developing roller 44 and a control member 45, and a toner T is stored in the developing tank 41. Further, as the case requires, the developing apparatus 4 may have a supply apparatus (not shown) which supplies the toner T. The supply apparatus is constituted so that the toner T can be supplied from a container such as a bottle or a cartridge.

The supply roller 43 is formed from e.g. an electrically conductive sponge. The developing roller 44 is a metal roll of e.g. iron, stainless steel, aluminum or nickel or a resin roll having such a metal roll covered with a silicon resin, a urethane resin, a fluororesin or the like. A smoothing treatment or a roughening treatment may be applied to the surface of the developing roller 44 as the case requires.

The developing roller 44 is disposed between the electrophotographic photoreceptor 1 and the supply roller 43, and is in contact with each of the electrophotographic photoreceptor 1 and the supply roller 43. The supply roller 43 and the developing roller 44 are rotated by a rotation driving mechanism (not shown). The supply roller 43 supports the stored toner T and supplies it to the developing roller 44. The developing roller 44 supports the toner T supplied by the supply roller 43 and brings it into contact with the surface of the electrophotographic photoreceptor 1.

The control member 45 is formed by a resin blade of e.g. a silicone resin or a urethane resin, a metal blade of e.g. stainless steel, aluminum, copper, brass or phosphor bronze, or a blade having such a metal blade covered with a resin. The control member 45 is in contact with the developing roller 44, and is pressed under a predetermined force to the side of the developing roller 44 by e.g. a spring (general blade linear pressure is from 5 to 500 g/cm). As the case requires, the control member 45 may have a function to charge the toner T by means of frictional electrification with the toner T.

The agitator 42 is rotated by a rotation driving mechanism, and stirs the toner T and transports the toner T to the supply roller 43. A plurality of agitators 42 with different blade shapes or sizes may be provided.

The type of the toner T is optional, and in addition to a powdery toner, a polymerized toner obtained by means of e.g. suspension polymerization or emulsion polymerization, and the like, may be used. Particularly when a polymerized toner is used, preferred is one having small particle sizes of from about 4 to about 8 μm. Further, with respect to the shape of particles of the toner, nearly spherical particles and particles which are not spherical, such as potato-shape particles, may be variously used. The polymerized toner is excellent in charging uniformity and transfer properties, and is favorably used to obtain a high quality image.

The type of the transfer apparatus 5 is not particularly limited, and an apparatus of optional method such as an electrostatic transfer method such as corona transfer, roller transfer or belt transfer, a pressure transfer method or an adhesive transfer method may be used. In this case, the transfer apparatus 5 comprises a transfer charger, a transfer roller, a transfer belt and the like which are disposed to face the electrophotographic photoreceptor 1. The transfer apparatus 5 applies a predetermined voltage (transfer voltage) at a polarity opposite to the charge potential of the toner T and transfers a toner image formed on the electrophotographic photoreceptor 1 to a recording paper (paper sheet, medium) P.

The cleaning apparatus 6 is not particularly limited, and an optional cleaning apparatus such as a brush cleaner, a magnetic brush cleaner, an electrostatic brush cleaner, a magnetic roller cleaner or a blade cleaner may be used. The cleaning apparatus 6 is to scrape away the remaining toner attached to the photoreceptor 1 by a cleaning member and to recover the remaining toner. If there is no or little toner remaining on the photoreceptor, the cleaning apparatus 6 is not necessarily provided.

The fixing apparatus 7 comprises an upper fixing member (fixing roller) 71 and a lower fixing member (fixing roller) 72, and a heating apparatus 73 is provided in the interior of the fixing member 71 or 72. FIG. 1 illustrates an example wherein the heating apparatus 73 is provided in the interior of the upper fixing member 71. As each of the upper and lower fixing members 71 and 72, a known heat fixing member such as a fixing roll comprising a metal cylinder of e.g. stainless steel or aluminum covered with a silicon rubber, a fixing roll further covered with a fluororesin or a fixing sheet may be used. Further, each of the fixing members 71 and 72 may have a structure to supply a release agent such as a silicone oil so as to improve the releasability, or may have a structure to forcibly apply a pressure to each other by e.g. a spring.

The toner transferred on the recording paper P is heated to a molten state when it passes through the upper fixing member 71 and the lower fixing member 72 heated to a predetermined temperature, and then cooled after passage and fixed on the recording paper P.

The type of the fixing apparatus is also not particularly limited, and one used in this case, and further, a fixing apparatus by an optional method such as heated roller fixing, flash fixing, oven fixing or pressure fixing may be provided.

In the electrophotographic apparatus constituted as mentioned above, recording of an image is carried out as follows. Namely, the surface (photosensitive surface) of the photoreceptor 1 is charged to a predetermined potential (−600 V for example) by the charging apparatus 2. In this case, it may be charged by a direct voltage or may be charged by superposing an alternating voltage to a direct voltage.

Then, the charged photosensitive surface of the photoreceptor 1 is exposed by means of the exposure apparatus 3 in accordance with the image to be recorded to form an electrostatic latent image on the photosensitive surface. Then, the electrostatic latent image formed on the photosensitive surface of the photoreceptor 1 is developed by the developing apparatus 4.

The developing apparatus 4 forms the toner T supplied by the supply roller 43 into a thin layer by the control member (developing blade) 45 and at the same time, charges the toner T to a predetermined polarity (in this case, the same polarity as the charge potential of the photoreceptor 1 and negative polarity) by means of frictional electrification, transfers it while supporting it by the developing roller 44 and brings it into contact with the surface of the photoreceptor 1.

When the charged toner T supported by the developing roller 44 is brought into contact with the surface of the photoreceptor 1, a toner image corresponding to the electrostatic latent image is formed on the photosensitive surface of the photoreceptor 1. Then, the toner image is transferred to the recording paper P by the transfer apparatus 5. Then, the toner remaining on the photosensitive surface of the photoreceptor 1 without being transferred is removed by the cleaning apparatus 6.

After the toner image is transferred to the recording paper P, the recording paper P is made to pass through the fixing apparatus 7 so that the toner image is heat fixed on the recording paper P, whereby an image is finally obtained.

The image forming apparatus may have a structure capable of carrying out a charge removal step in addition to the above-described structure. The charge removal step is a step of carrying out charge removal of the electrophotographic photoreceptor by exposing the electrophotographic photoreceptor. As a charge removal apparatus, a fluorescent lamp or LED may, for example, be used. Further, the light used in the charge removal step, in terms of intensity, is a light having an exposure energy at least three times the exposure light in many cases.

Further, the image forming apparatus may have a further modified structure, and it may have, for example, a structure capable of carrying out e.g. a pre-exposure step or a supplementary charging step, a structure of carrying out offset printing or a full color tandem structure employing plural types of toners.

EXAMPLES

Now, the present invention will be described in further detail with reference to Examples and Comparative Examples, but the present invention is by no means restricted thereto without departing from the intension and the scope of the present invention.

"Part(s)" used in Examples represents "part(s) by weight" unless otherwise specified.

Example 1

1 kg of a raw slurry obtained by mixing 50 parts of surface-treated titanium oxide obtained by mixing rutile titanium oxide ("TTO55N" manufactured by Ishihara Sangyo Kaisha, Ltd.) having an average primary particle size of 40 nm and methyldimethoxysilane ("TSL8117" manufactured by GE Toshiba Silicones) in an amount of 3 wt % based on the titanium oxide by a Henschel mixer, and 120 parts of methanol, was subjected to dispersion treatment by using zirconia beads (YTZ manufactured by NIKKATO CORPORATION) having a diameter of about 100 μm as a dispersing medium, by using ULTRA APEX MILL (model UAM-015, manufactured by KOTOBUKI INDUSTRIES CO., LTD.) at a rotor circumferential speed of 10 m/sec in a liquid-circulating state with a liquid flow rate of 10 kg/hr for one hour to prepare a titanium oxide dispersion liquid.

The above titanium oxide dispersion liquid, a solvent mixture of methanol/1-propanol/toluene, and pellets of a copolymer polyamide comprising ∈-caprolactam (compound of the following formula (A))/bis(4-amino-3-methylcyclohexyl) methane (compound of the following formula (B))/hexamethylenediamine (compound of the following formula (C))/decamethylenedicarboxylic acid (compound of the following formula (D))/octadecamethylenedicarboxylic acid (compound of the following formula (E)) in a molar ratio of 75%/9.5%/3%/9.5%/3% were stirred and mixed with heating to dissolve the polyamide pellets. Then, ultrasonic dispersion treatment by an ultrasonic oscillator at an output of 1,200 W was carried out for one hour, and then the mixture was subjected to filtration with a PTFE membrane filter (Mitex LC manufactured by ADVANTEC) with a pore size of 5 μm, to obtain a coating fluid A for forming an undercoat layer containing surface-treated titanium oxide/copolymer polyamide in a weight ratio of 3/1, in a solvent mixture of methanol/1-propanol/toluene in a weight ratio of 7/1/2 at a concentration of solid content contained of 18.0 wt %.

A

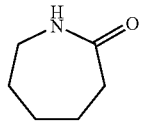

B

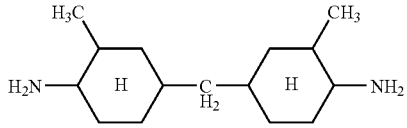

C

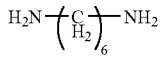

D

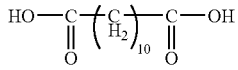

E

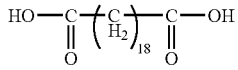

With respect to the coating fluid A for forming an undercoat layer, the rate of change in viscosity as between at the time of preparation and after storage at room temperature for 120 days (a value obtained by dividing the difference between the viscosity after storage for 120 days and the viscosity at the time of preparation by the viscosity at the time of preparation) and the particle size distribution of titanium oxide at the time of preparation were measured. The viscosity was measured by using a cone/plate viscometer (ED, product name, manufactured by TOKIMEC INC.) by a method in accordance with JIS Z 8803, and the particle size distribution was measured by using a particle size analyzer (MICROTRAC UPA (model 9340), trade name, manufactured by NIKKISO CO., LTD.) at 25° C. after the sample was diluted with a mixed solvent of methanol/1-propanol=7/3 so that the sample concentration index (signal level) was from 0.6 to 0.8. Further, as the particle size, in a cumulative curve with the total volume of the titanium oxide particles being 100%, the particle size at a point of 50% in the cumulative curve was regarded as the volume average particle size (median diameter), and the particle size at a point of 90% in the cumulative curve was regarded as the cumulative 90% particle size. The results are shown in Table 2.

Example 2

A coating fluid B for forming an undercoat layer was prepared in the same manner as in Example 1 except that zirconia beads (YTZ manufactured by NIKKATO CORPORATION) having a diameter of about 50 μm were used as a dispersing medium at the time of dispersing by ULTRA APEX MILL; and physical properties were measured in the same manner as in Example 1. The results are shown in Table 2. Further, the coating fluid B for forming an undercoat layer was diluted into a dispersion liquid in a solvent mixture of methanol/1-propanol=7/3 (weight ratio) so that the solid content concentration was 0.015 wt % (metal oxide particles concentration: 0.011 wt %), and the difference between the absorbance of the diluted liquid to a light having a wavelength of 400 nm and the absorbance to a light having a wavelength of 1,000 nm was measured. The results are shown in Table 3.

Example 3

The coating fluid C for forming an undercoat layer was prepared in the same manner as in Example 2 except that the rotor circumferential speed at the time of dispersing by ULTRA APEX MILL was 12 m/sec; and physical properties were measured in the same manner as in Example 1. The results are shown in Table 2.

Example 4

A coating fluid D for forming an undercoat layer was prepared in the same manner as in Example 3 except that zirconia beads (YTZ manufactured by NIKKATO CORPORATION) having a diameter of about 30 μm were used as the dispersing medium at the time of dispersing by ULTRA APEX MILL; and physical properties were measured in the same manner as in Example 1. The results are shown in Table 2.

Example 5

A coating fluid E for forming an undercoat layer was prepared in the same manner as in Example 2 except that the weight ratio of the surface-treated titanium oxide/copolymer polyamide used in Example 2 was 2/1; and the difference between the absorbance to a light having a wavelength of 400 nm and the absorbance to a light having a wavelength of 1,000 nm was measured in the same manner as in Example 2 except that the solid content concentration was 0.015 wt % (metal oxide particles concentration: 0.01 wt %). The results are shown in Table 3.

Example 6

A coating fluid F for forming an undercoat layer was prepared in the same manner as in Example 2 except that the weight ratio of the surface-treated titanium oxide/copolymer polyamide was 4/1; and the difference between the absorbance to a light having a wavelength of 400 nm and the absorbance to a light having a wavelength of 1,000 nm was measured in the same manner as in Example 2 except that the solid content concentration was 0.015 wt % (metal oxide particles concentration: 0.012 wt %). The results are shown in Table 3.

Example 7

A coating fluid G for forming an undercoat layer was prepared in the same manner as in Example 2 except that aluminum oxide particles (Aluminum Oxide C manufactured by NIPPON AEROSIL CO., LTD.) having an average primary particle size of 13 nm were used instead of the surface-treated titanium oxide used in Example 1, that the concentration of solid content contained was 8.0 wt %, and that the weight ratio of the aluminum oxide particles/copolymer polyamide was 1/1; and the difference between the absorbance to a light having a wavelength of 400 nm and the absorbance to a light having a wavelength of 1,000 nm was measured in the same manner as in Example 2 except that the coating fluid was diluted so that the concentration of the solid content was 0.015 wt % (metal oxide particles concentration: 0.0075 wt %). The results are shown in Table 3.

Comparative Example 1

A coating fluid H for forming an undercoat layer was prepared in the same manner as in Example 1 except that a dispersed slurry obtained by mixing 50 parts of the surface-treated titanium oxide and 120 parts of methanol and dispersing the mixture in a ball mill using alumina balls (HD manufactured by NIKKATO CORPORATION) having a diameter of about 5 mm was used as it was without dispersing using ULTRA APEX MILL; and physical properties were measured in the same manner as in Example 2 except that the solid content concentration was 0.015 wt % (metal oxide particles concentration: 0.011 wt %). The results are shown in Tables 2 and 3.

Comparative Example 2

A coating fluid I for forming an undercoat layer was prepared in the same manner as in Comparative Example 1 except that zirconia balls (YTZ manufactured by NIKKATO CORPORATION) having a diameter of about 5 mm were used instead of the balls used for dispersion in a ball mill in Comparative Example 1; and physical properties were measured in the same manner as in Example 1. The results are shown in Table 2.

Comparative Example 3

A coating fluid J for forming an undercoat layer was prepared in the same manner as in Comparative Example 1 except that the weight ratio of the surface-treated titanium oxide/copolymer polyamide was 2/1; and the difference between the absorbance to a light having a wavelength of 400 nm and the absorbance to a light having a wavelength of 1,000 nm was measured in the same manner as in Example 2 except that the solid content concentration was 0.015 wt % (metal oxide particles concentration: 0.01 wt %). The results are shown in Table 3.

Comparative Example 4

A coating fluid K for forming an undercoat layer was prepared in the same manner as in Comparative Example 1 except that the weight ratio of the surface-treated titanium oxide/copolymer polyamide was 4/1; and the difference between the absorbance to a light having a wavelength of 400 nm and the absorbance to a light having a wavelength of 1,000 nm was measured in the same manner as in Example 2 except that the solid content concentration was 0.015 wt % (metal oxide particles concentration: 0.012 wt %). The results are shown in Table 3.

Example 8

A coating fluid L for forming an undercoat layer was prepared in the same manner as in Example 2 except that ULTRA APEX MILL (model UAM-1) manufactured by KOTOBUKI INDUSTRIES CO., LTD. with a mill volume of about 1 L was used instead of ULTRA APEX MILL (model UAM-015) manufactured by KOTOBUKI INDUSTRIES CO., LTD. as the dispersing apparatus, and that the flow rate of the coating fluid for forming an undercoat layer was 30 kg/hr; and physical properties were measured in the same manner as in Example 1. The results are shown in Table 2.

Example 9

A coating fluid M for forming an undercoat layer was prepared in the same manner as in Example 1 except that ULTRA APEX MILL (model UAM-1) manufactured by KOTOBUKI INDUSTRIES CO., LTD. with a mill volume of about 1 L was used instead of ULTRA APEX MILL (model UAM-015) manufactured by KOTOBUKI INDUSTRIES CO., LTD. as the dispersing apparatus, that zirconia beads (YTZ manufactured by NIKKATO Corporation) having a diameter of about 30 μm were used as the dispersing medium, that the rotor circumferential speed was 12 m/sec and that the flow rate of the coating fluid for forming an undercoat layer was 30 kg/hr; and physical properties were measured in the same manner as in Example 1. The results are shown in Table 2.

Comparative Example 5

A coating fluid N for forming an undercoat layer was prepared in the same manner as in Comparative Example 1 except that aluminum oxide C (aluminum oxide particles) manufactured by NIPPON AEROSIL CO., LTD. having an average primary particle size of 13 nm was used instead of the surface-treated titanium oxide, that the concentration of the solid content contained was 8.0 wt %, that the weight ratio of the aluminum oxide particles/copolymer polyamide was 1/1, and that dispersion was carried out for 6 hours by an ultrasonic oscillator at an output of 600 W instead of dispersing in a ball mill; and the difference between the absorbance to a light having a wavelength of 400 nm and the absorbance to a light having a wavelength of 1,000 nm was measured in the same manner as in Example 2 except that the solid content concentration was 0.015 wt % (metal oxide particles concentration: 0.0075 wt %). The results are shown in Table 3.

(Evaluation of Specular Reflectance)

The ratio of the specular reflection of an undercoat layer formed on an electroconductive substrate using each of the coating fluids for forming an undercoat layer prepared in Examples 2 and 5 to 7 and Comparative Examples 1 and 3 to 5 was evaluated as follows. The results are shown in Table 5.

On aluminum cylinders (drawn mirror tube and cut tube) having an outer diameter of 30 mm, a length of 250 mm and a thickness of 0.8 mm as identified in Table 4, the coating fluid for forming an undercoat layer as identified in Table 4 was applied so that the film thickness after drying was 2 μm, and dried to form an undercoat layer.

The reflectance of the undercoat layer to a light at 400 nm or a light at 480 nm was measured by a multi channel spectrophotometer (MCPD-3000 manufactured by OTSUKA ELECTRONICS CO., LTD.). A halogen lamp was used as the light source, and the tip of an optical fiber cable of the light source and a detector was placed with a distance of 2 mm in a perpendicular direction from the surface of the undercoat layer, a light in a direction perpendicular to the surface of the undercoat layer was made to enter the undercoat layer, and a light reflected concentrically in the reverse direction was detected. Such measurement of the reflected light was carried out with respect to the surface of an aluminum cut tube on which no undercoat layer was applied, the obtained value was regarded as 100%, and the proportion of the reflected light on the surface of the undercoat layer measured was taken as the specular reflectance (%).

TABLE 2

Physical properties of coating fluid for forming an undercoat layer

| | Coating fluid | Medium | Medium diameter | Rotor circumferential speed | Rate of change in viscosity | Average particle size | Cumulative 90% particle size |
|---|---|---|---|---|---|---|---|
| Ex. 1 | A | Zirconia | 100 μm | 10 m/s | Increase of 6% | 0.09 μm | 0.13 μm |
| Ex. 2 | B | Zirconia | 50 μm | 10 m/s | Increase of 2% | 0.08 μm | 0.13 μm |
| Ex. 3 | C | Zirconia | 50 μm | 12 m/s | Increase of 4% | 0.08 μm | 0.12 μm |
| Ex. 4 | D | Zirconia | 30 μm | 12 m/s | Increase of 2% | 0.08 μm | 0.12 μm |
| Ex. 7 | G | Zirconia | 50 μm | 10 m/s | — | 0.09 μm | 0.16 μm |
| Ex. 8 | L | Zirconia | 50 μm | 10 m/s | — | 0.07 μm | 0.10 μm |
| Ex. 9 | M | Zirconia | 30 μm | 12 m/s | — | 0.07 μm | 0.10 μm |
| Comp. Ex. 1 | H | Alumina | 5 mm | — | Increase of 38.5% | 0.13 μm | 0.20 μm |
| Comp. Ex. 2 | I | Zirconia | 5 mm | — | — | 1.25 μm | 3.36 μm |
| Comp. Ex. 5 | N | Alumina | 5 mm | — | — | 0.17 μm | 0.25 μm |

—: Not applicable, or not measured

TABLE 3

Absorbance of coating fluid for forming an undercoat layer

| | Coating fluid | Metal oxide particles/ copolymer polyamide (weight ratio) | Metal oxide particles concentration (wt %) | Difference in absorbance (Abs) |
|---|---|---|---|---|
| Ex. 2 | B | 3/1 | 0.011 | 0.688 |
| Ex. 5 | E | 2/1 | 0.01 | 0.980 |
| Ex. 6 | F | 4/1 | 0.012 | 0.919 |
| Ex. 7 | G | 1/1 | 0.0075 | 0.014 |
| Comp. Ex. 1 | H | 3/1 | 0.011 | 1.649 |
| Comp. Ex. 3 | J | 2/1 | 0.01 | 1.076 |
| Comp. Ex. 4 | K | 4/1 | 0.012 | 1.957 |
| Comp. Ex. 5 | N | 1/1 | 0.0075 | 0.056 |

TABLE 4

| Specular reflectance of undercoat layer (%) | | | | | |
|---|---|---|---|---|---|
| | Coating fluid | Measurement wavelength | Drawn mirror tube | Cut tube (cutting pitch: 0.6 mm) | Cut tube (cutting pitch: 0.95 mm) |
| Ex. 2 | B | 480 nm | 57.4 | 57.3 | 57.8 |
| Ex. 5 | E | 480 nm | 56.7 | 56.4 | 54.9 |
| Ex. 6 | F | 480 nm | 57.6 | 56.5 | 58.6 |
| Ex. 7 | G | 400 nm | 64.6 | 65.4 | 57.2 |
| Comp. Ex. 1 | H | 480 nm | 40.2 | 39.8 | 41.8 |
| Comp. Ex. 3 | J | 480 nm | 35.8 | 37.1 | 37.5 |
| Comp. Ex. 4 | K | 480 nm | 26.2 | 25.0 | 27.5 |
| Comp. Ex. 5 | N | 400 nm | 48.3 | 49.0 | 39.6 |

The coating fluid for forming an undercoat layer prepared by the method of the present invention, of which the average particle size is small, and the width of the distribution of the particle sizes is small, is highly stable and is capable of forming a uniform undercoat layer, and is stable with a small change in viscosity even after storage for a long period of time. Further, an undercoat layer formed by applying the coating fluid for forming an undercoat layer is highly uniform and hardly scatters light, thereby provides a high specular reflectance.

Example 10

The coating fluid A for forming an undercoat layer was applied to an aluminum cut tube having an outer diameter of 24 mm, a length of 236.5 mm and a thickness of 0.75 mm by dip coating so that the film thickness after drying was 2 μm and dried to form an undercoat layer. The surface of the undercoat layer was observed by a scanning electron microscope and as a result, substantially no agglomerated product was observed.

Figure 2:
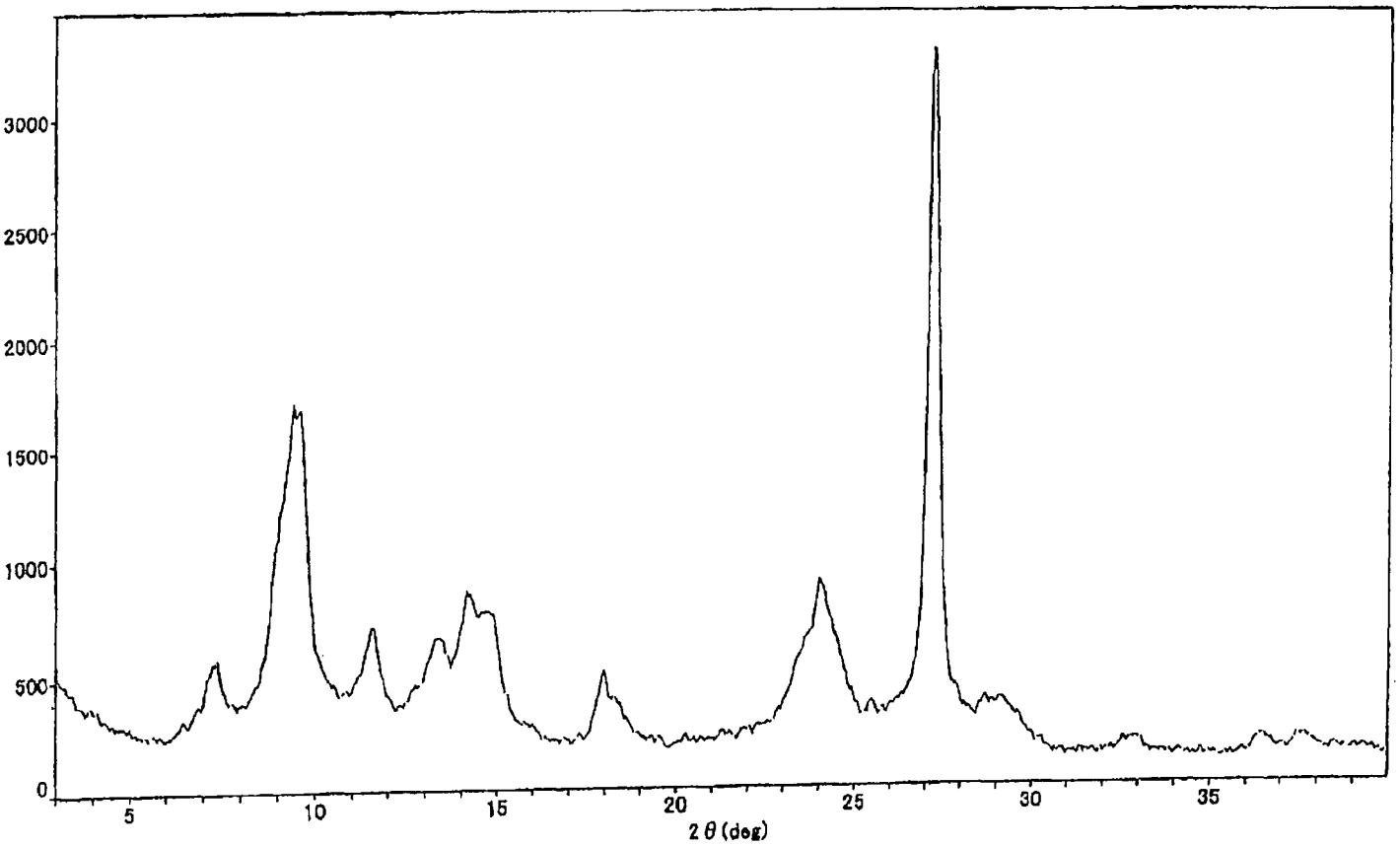
FIG. 2 is a powder X-ray diffraction spectrum pattern of oxytitanium phthalocyanine used as a charge generation material in electrophotographic photoreceptors in Examples 10 to 24, to CuKα characteristic X-rays.

As a charge generation material, 20 parts of oxytitanium phthalocyanine having a powder X-ray diffraction spectrum pattern to CuKα characteristic X-ray shown in FIG. 2 and 280 parts of 1,2-dimethoxyethane were mixed, followed by dispersion treatment in a sand grinding mill for 2 hours to prepare a dispersion liquid. Then, this dispersion liquid, 10 parts of polyvinyl butyral ("DENKA BUTYRAL" #6000C, trade name, manufactured by Denki Kagaku Kogyo Kabushiki Kaisha), 235 parts of 1,2-dimethoxyethane and 85 parts of 4-methoxy-4-methylpentanone-2 were mixed, and 234 parts of 1,2-dimethoxyethane was further mixed, followed by ultrasonic dispersion treatment. Then, the mixture was subjected to filtration through a PTFE membrane filter (Mitex LC manufactured by ADVANTEC) with a pore size of 5 μm to prepare a coating fluid for a charge generation layer. This coating fluid for a charge generation layer was applied on the above undercoat layer by dip coating so that the film thickness after drying was 0.4 μm and dried to form a charge generation layer.

Then, on the charge generation layer, a coating fluid for a charge transport layer obtained by dissolving 56 parts of the following hydrazone compound:

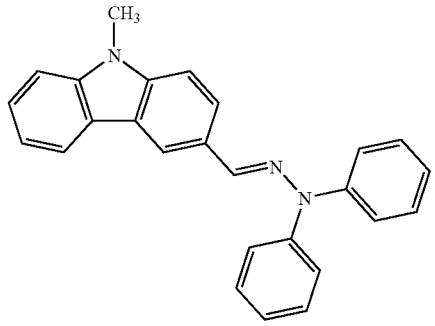

14 parts of the following hydrazone compound:

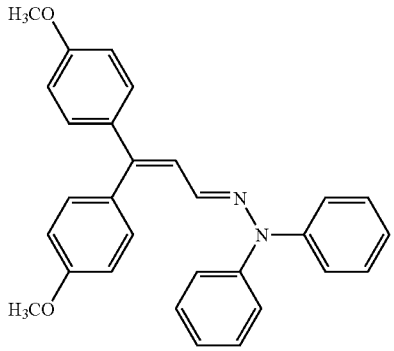

100 parts of a polycarbonate resin having the following repeating structure:

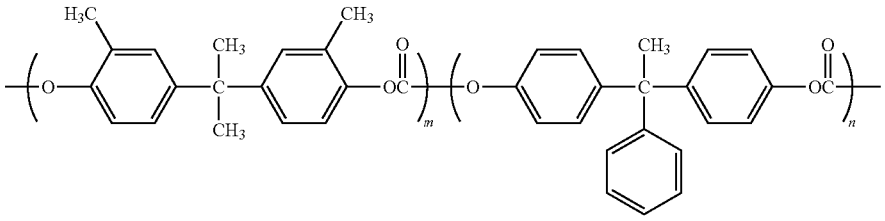

(m:n = 1:1)

and 0.05 part of a silicone oil dissolved in 640 parts of a solvent mixture of tetrahydrofuran/toluene (8/2) was applied so that the film thickness after drying was 17 μm and air-dried at room temperature for 25 minutes. It was further dried at 125° C. for 20 minutes to provide a charge transport layer thereby to prepare an electrophotographic photoreceptor, which will be referred to as a photoreceptor P1.

The dielectric breakdown strength of the photoreceptor P1 was measured as follows. Namely, the photoreceptor was fixed in an environment at a temperature of 25° C. at a relative humidity of 50%, a charging roller shorter by about 2 cm at each end than the drum length, having a volume resistivity of about 2 MΩ·cm, was pressed against the photoreceptor and a direct voltage of −3 kV was applied, whereupon the time until the dielectric breakdown was measured. The results are shown in Table 5.

Further, the photoreceptor was set to an electrophotographic characteristic evaluation apparatus (described on pages 404 to 405 in "Electrophotography—Bases and applications, second series" edited by the Society of Electrophotography, published by CORONA PUBLISHING CO., LTD.), manufactured in accordance with the measurement standard by the Society of Electrophotography, and charged so that the surface potential was −700 V, and then irradiated with a laser beam at 780 nm at an intensity of 5.0 μJ/cm$^2$. The surface potential 100 msec after the exposure was measured in an environment at 25° C. at 50% (hereinafter sometimes referred to as NN environment) and in an environment at a temperature of 5° C. at a relative humidity of 10% (hereinafter sometimes referred to as LL environment). The results are shown in Table 5.

Example 11

A photoreceptor P2 was prepared in the same manner as in Example 10 except that the undercoat layer was provided with a film thickness of 3 μm. During the preparation of the photoreceptor, the surface of the undercoat layer was observed by a scanning electron microscope in the same manner as in Example 10 and as a result, substantially no agglomerated product was observed. The photoreceptor P2 was evaluated in the same manner as in Example 10, and the results are shown in Table 5.

Example 12

A coating fluid A2 for forming an undercoat layer was prepared in the same manner as in Example 1 except that the weight ratio of titanium oxide and the copolymer polyamide was titanium oxide/copolymer polyamide=2/1.

A photoreceptor P3 was prepared in the same manner as in Example 10 except that the coating fluid A2 was used as the coating fluid for forming an undercoat layer. During the preparation of the photoreceptor, the surface of the undercoat layer was observed by a scanning electron microscope in the same manner as in Example 10 and as a result, substantially no agglomerated product was observed. The photoreceptor P3 was evaluated in the same manner as in Example 10, and the results are shown in Table 5.

Example 13

A photoreceptor Q1 was prepared in the same manner as in Example 10 except that the coating fluid B for forming an undercoat layer prepared in Example 2 was used as the coating fluid for forming an undercoat layer. During the preparation of the photoreceptor, the surface of the undercoat layer was observed by a scanning electron microscope in the same manner as in Example 10 and as a result, substantially no agglomerated product was observed. The surface state of the undercoat layer was measured by Micromap of Ryoka Systems Inc. at wave mode at a measurement wavelength of 552 nm, at a magnification of objective lens of 40 times, with a measurement area of 190 μm×148 μm with background shape correction (Term) of cylinder, and as a result, the in-plane root mean square roughness (RMS) was 43.2 nm, the in-plane arithmetic mean roughness (Ra) was 30.7 nm, and the in-plane maximum roughness (P-V) was 744 nm. The photoreceptor Q1 was evaluated in the same manner as in Example 10, and the results are shown in Table 5.

Example 14

A photoreceptor Q2 was prepared in the same manner as in Example 13 except that the undercoat layer was provided to have a film thickness of 3 μm. During the preparation of the photoreceptor, the surface of the undercoat layer was observed by a scanning electron microscope in the same manner as in Example 10 and as a result, substantially no agglomerated product was observed. The photoreceptor Q2 was evaluated in the same manner as in Example 10, and the results are shown in Table 5.

Example 15

A photoreceptor Q1 was prepared in the same manner as in Example 13 except that the coating fluid E was used as the coating fluid for forming an undercoat layer. During the preparation of the photoreceptor, the surface of the undercoat layer was observed by a scanning electron microscope in the same manner as in Example 10 and as a result, substantially no agglomerated product was observed. The photoreceptor Q3 was evaluated in the same manner as in Example 10, and the results are shown in Table 5.

Example 16

A photoreceptor R1 was prepared in the same manner as in Example 10 except that the coating fluid C for forming an undercoat layer prepared in Example 3 was used as the coating fluid for forming an undercoat layer. During the preparation of the photoreceptor, the surface of the undercoat layer was observed by a scanning electron microscope in the same manner as in Example 10 and as a result, substantially no agglomerated product was observed. The photoreceptor R1 was evaluated in the same manner as in Example 10, and the results are shown in Table 5.

Example 17

A photoreceptor R2 was prepared in the same manner as in Example 16 except that the undercoat layer was provided to have a film thickness of 3 μm. During the preparation of the photoreceptor, the surface of the undercoat layer was observed by a scanning electron microscope in the same manner as in Example 10 and as a result, substantially no agglomerated product was observed. The photoreceptor R2 was evaluated in the same manner as in Example 10, and the results are shown in Table 5.

Example 18

A coating fluid C2 for forming an undercoat layer was prepared in the same manner as in Example 3 except that the weight ratio of the titanium oxide to the copolymer polyamide was titanium oxide/copolymer polyamide=2/1.

A photoreceptor R3 was prepared in the same manner as in Example 16 except that the coating fluid C2 was used as the coating fluid for forming an undercoat layer. During the preparation of the photoreceptor, the surface of the undercoat layer was observed by a scanning electron microscope in the same manner as in Example 10 and as a result, substantially no agglomerated product was observed. The photoreceptor R3 was evaluated in the same manner as in Example 10, and the results are shown in Table 5.

Example 19

A photoreceptor S1 was prepared in the same manner as in Example 10 except that the coating fluid D for forming an undercoat layer prepared in Example 4 was used as the coating fluid for forming an undercoat layer. During the preparation of the photoreceptor, the surface of the undercoat layer was observed by a scanning electron microscope in the same manner as in Example 10 and as a result, substantially no agglomerated product was observed. Further, the surface state of the undercoat layer was measured in the same manner as in Example 13 and as a result, the in-plane root mean square roughness (RMS) was 25.5 nm, the in-plane arithmetic mean roughness (Ra) was 17.7 nm, and the in-plane maximum roughness (P-V) was 510 nm. The photoreceptor S1 was evaluated in the same manner as in Example 10, and the results are shown in Table 5.

Example 20

A photoreceptor S2 was prepared in the same manner as in Example 19 except that the undercoat layer was provided to have a film thickness of 3 μm. During the preparation of the photoreceptor, the surface of the undercoat layer was observed by a scanning electron microscope in the same manner as in Example 10 and as a result, substantially no agglomerated product was observed. The photoreceptor S2 was evaluated in the same manner as in Example 10, and the results are shown in Table 5.

Example 21

A coating fluid D2 for forming an undercoat layer was prepared in the same manner as in Example 4 except that the weight ratio of the titanium oxide to the copolymer polyamide was titanium oxide/copolymer polyamide=2/1.

A photoreceptor S3 was prepared in the same manner as in Example 19 except that the coating fluid D2 was used as the coating fluid for forming an undercoat layer. During the preparation of the photoreceptor, the surface of the undercoat layer was observed by a scanning electron microscope in the same manner as in Example 10 and as a result, substantially no agglomerated product was observed. The photoreceptor S3 was evaluated in the same manner as in Example 10, and the results are shown in Table 5.

Comparative Example 6

A photoreceptor T1 was prepared in the same manner as in Example 10 except that the coating fluid H for forming an undercoat layer prepared in Comparative Example 1 was used as the coating fluid for forming an undercoat layer. During the preparation of the photoreceptor, the surface of the undercoat layer was observed by a scanning electron microscope in the same manner as in Example 10 and as a result, many titanium oxide agglomerated products were observed. Further, the surface state of the undercoat layer was measured in the same manner as in Example 13 and as a result, the in-plane root mean square roughness (RMS) was 148.4 nm, the in-plane arithmetic mean roughness (Ra) was 95.3 nm, and the in-plane maximum roughness (P-V) was 2,565 nm. The photoreceptor T1 was evaluated in the same manner as in Example 10, and the results are shown in Table 5.

Comparative Example 7

A photoreceptor T2 was prepared in the same manner as in Comparative Example 6 except that the undercoat layer was provided to have a film thickness of 3 μm. During the preparation of the photoreceptor, the surface of the undercoat layer was observed by a scanning electron microscope in the same manner as in Example 10 and as a result, many titanium oxide agglomerated products were observed. The photoreceptor T2 was evaluated in the same manner as in Example 10, and the results are shown in Table 5.

Comparative Example 8

A photoreceptor T3 was prepared in the same manner as in Comparative Example 6 except that the coating fluid J was used as the coating fluid for forming an undercoat layer. During the preparation of the photoreceptor, the surface of the undercoat layer was observed by a scanning electron microscope in the same manner as in Example 10 and as a result, many titanium oxide agglomerated products were observed. The photoreceptor T3 was evaluated in the same manner as in Example 10, and the results are shown in Table 5.

Comparative Example 9

A photoreceptor U1 was prepared in the same manner as in Example 10 except that the coating fluid I for forming an undercoat layer prepared in Comparative Example 2 was used as the coating fluid for forming an undercoat layer. During the preparation of the photoreceptor, the surface of the undercoat layer was observed by a scanning electron microscope in the same manner as in Example 10 and as a result, many titanium oxide agglomerated products were observed. Electronic characteristics of the photoreceptor U1 could not be evaluated since the component and the thickness of the undercoat layer were significantly uneven.

TABLE 5

Electric characteristics of photoreceptor and time until dielectric breakdown

| | Photo-receptor | Titanium oxide/copolymer polyamide (weight ratio) | Film thickness of undercoat layer | VL (NN) | VL (LL) | Time until dielectric breakdown |
|---|---|---|---|---|---|---|
| EX. 10 | P1 | 3/1 | 2 μm | −76 V | −173 V | 19.4 min. |
| Ex. 11 | P2 | 3/1 | 3 μm | — | — | — |

TABLE 5-continued

Electric characteristics of photoreceptor and time until dielectric breakdown

| | Photo-receptor | Titanium oxide/copolymer polyamide (weight ratio) | Film thickness of undercoat layer | VL (NN) | VL (LL) | Time until dielectric breakdown |
|---|---|---|---|---|---|---|
| Ex. 12 | P3 | 2/1 | 2 μm | −98 V | −221 V | 21.8 min. |
| Ex. 13 | Q1 | 3/1 | 2 μm | −77 V | −174 V | 18.5 min. |
| Ex. 14 | Q2 | 3/1 | 3 μm | −82 V | −195 V | — |
| Ex. 15 | Q3 | 2/1 | 2 μm | −98 V | −223 V | 21.4 min. |
| Ex. 16 | R1 | 3/1 | 2 μm | −77 V | −161 V | 16.1 min. |
| Ex. 17 | R2 | 3/1 | 3 μm | −81 V | −176 V | — |
| Ex. 18 | R3 | 2/1 | 2 μm | −102 V | −218 V | 20.2 min. |
| Ex. 19 | S1 | 3/1 | 2 μm | −83 V | −176 V | 13.6 min. |
| Ex. 20 | S2 | 3/1 | 3 μm | −87 V | −191 V | — |
| Ex. 21 | S3 | 2/1 | 2 μm | −109 V | −232 V | 21.4 min. |
| Comp. Ex. 6 | T1 | 3/1 | 2 μm | −76 V | −151 V | 2.8 min. |
| Comp. Ex. 7 | T2 | 3/1 | 3 μm | −82 V | −175 V | — |
| Comp. Ex. 8 | T3 | 2/1 | 2 μm | −103 V | −215 V | 14.6 min. |
| Comp. Ex. 9 | U1 | 3/1 | 2 μm | — | — | — |

The electrophotographic photoreceptor of the present invention has a uniform undercoat layer free from agglomeration, etc., provides a small variation in potential by the environment, and is excellent in dielectric breakage resistance.

Example 22

The coating fluid B for forming an undercoat layer prepared in Example 2 as the coating fluid for forming an undercoat layer was applied on an aluminum cut tube having an outer diameter of 30 mm, a length of 295 mm and a thickness of 0.8 mm by dip coating so that the film thickness after drying was 2.4 μm and dried to form an undercoat layer. The surface of the undercoat layer was observed by a scanning electron microscope and as a result, substantially no agglomerated product was observed.

The undercoat layer with an area of 94.2 $cm^2$ was immersed in a solvent mixture of 70 $cm^3$ of methanol and 30 $cm^3$ of 1-propanol and subjected to ultrasonic treatment by an ultrasonic oscillator at an output of 600 W for 5 minutes to obtain a dispersion liquid of the undercoat layer, and the particle size distribution of metal oxide agglomerated secondary particles in the dispersion liquid was measured in the same manner as in Example 1 and as a result, the volume average particle size was 0.078 μm, and the cumulative 90% particle size was 0.108 μm.

The coating fluid for a charge generation layer prepared in the same manner as in Example 10 was applied on the above undercoat layer by dip coating so that the film thickness after drying was 0.4 μm and dried to form a charge generation layer.

Then, on the charge generation layer, as a charge transport material, a coating fluid having 60 parts of a composition (A) disclosed in JP-A-2002-080432 having the following structure as the main component:

Composition (A)

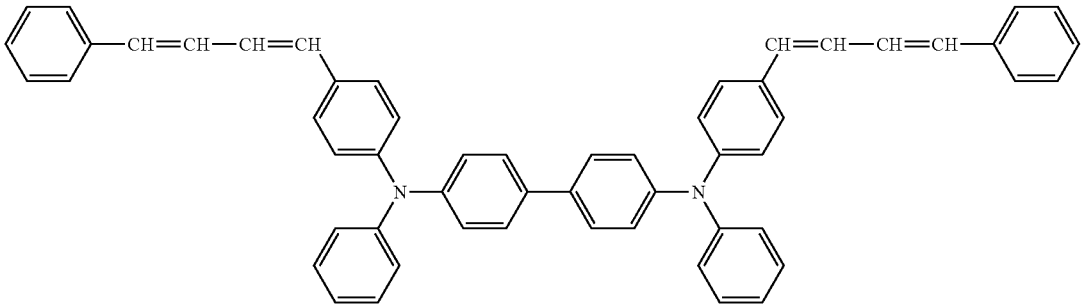

100 parts of a polycarbonate resin having the following repeating structure:

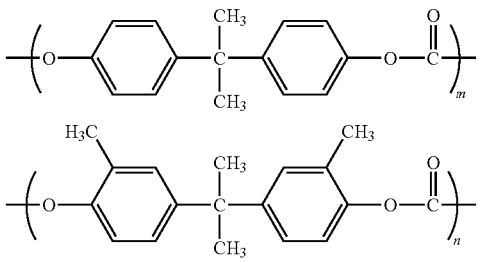

(m:n = 7:3)

and 0.05 part of a silicone oil dissolved in 640 parts of a solvent mixture of tetrahydrofuran/toluene (8/2) was applied so that the film thickness after drying was 10 μm and dried to provide a charge transport layer thereby to prepare an electrophotographic photoreceptor.

The photosensitive layer with an area of 94.2 $cm^2$ of the electrophotographic photoreceptor was immersed in 100 $cm^3$ of tetrahydrofuran and subjected to ultrasonic treatment by an ultrasonic oscillator at an output of 600 W for 5 minutes to dissolve and remove the photosensitive layer, and then that portion was immersed in a solvent mixture of 70 $cm^3$ of methanol and 30 $cm^3$ of 1-propanol and subjected to ultrasonic treatment by an ultrasonic oscillator at an output of 600 W for 5 minutes to obtain a dispersion liquid of the undercoat layer. The particle size distribution of metal oxide agglomerated secondary particles in the dispersion liquid was measured in the same manner as in Example 1 and as a result, the volume average particle size was 0.079 μm and the cumulative 90% particle size was 0.124 μm.

The prepared photoreceptor was set to a cartridge of a color printer manufactured by Seiko Epson Corporation (trade name: InterColor LP-1500C) to form a full color image, whereupon a favorable image was obtained. The number of very small color spots observed in a 1.6 cm square of the obtained image is shown in Table 6.

Example 23

A full color image was formed in the same manner as in Example 22 except that the coating fluid C for forming an undercoat layer prepared in Example 3 was used as the coating fluid for forming an undercoat layer, whereupon a favorable image was obtained. The number of very small color spots observed in a 1.6 cm square of the obtained image is shown in Table 6.

Example 24

A full color image was formed in the same manner as in Example 22 except that the coating fluid D for forming an undercoat layer prepared in Example 4 was used as the coating fluid for forming an undercoat layer, whereupon a favorable image was obtained. The number of very small color spots observed in a 1.6 cm square of the obtained image is shown in Table 6.

Comparative Example 10

An electrophotographic photoreceptor was prepared in the same manner as in Example 22 except that the coating fluid H for forming an undercoat layer prepared in Comparative Example 1 was used as the coating fluid for forming an undercoat layer.

The undercoat layer with an area of 94.2 $cm^2$ of the electrophotographic photoreceptor was immersed in a solvent mixture of 70 $cm^3$ of methanol and 30 $cm^3$ of 1-propanol and subjected to ultrasonic treatment by an ultrasonic oscillator at an output of 600 W for 5 minutes to obtain a dispersion liquid of the undercoat layer. The particle size distribution of metal oxide agglomerated secondary particles in the dispersion liquid was measured in the same manner as in Example 1 and as a result, the volume average particle size was 0.113 μm and the cumulative 90% particle size was 0.196 μm.

The photosensitive layer with an area of 94.2 $cm^2$ of the electrophotographic photoreceptor was immersed in 100 $cm^3$ of tetrahydrofuran and subjected to ultrasonic treatment by an ultrasonic oscillator at an output of 600 W for 5 minutes to dissolve and remove the photosensitive layer, and then that portion was immersed in a solvent mixture of 70 $cm^3$ of methanol and 30 $cm^3$ of 1-propanol and subjected to ultrasonic treatment by an ultrasonic oscillator at an output of 600 W for 5 minutes to obtain a dispersion liquid of the undercoat layer. The particle size distribution of metal oxide agglomerated secondary particles in the dispersion was measured in the same manner as in Example 1 and as a result, the volume average particle size was 0.123 μm and the cumulative 90% particle size was 0.193 μm.

A full color image was formed by using the electrophotographic photoreceptor, but many color spots were observed, and no favorable image could be obtained. The number of very small color spots observed in a 1.6 cm square of the obtained image is shown in Table 6.

TABLE 6

Evaluation of image by an image forming apparatus

| | Medium | Medium diameter | Rotor circumferential speed | Titanium oxide/copolymer polyamide (weight ratio) | Film thickness of undercoat layer | Image defects (number of very small color spots) | Image defects 3 mths. later (number of very small color spots) |
|---|---|---|---|---|---|---|---|
| Ex. 22 | Zirconia | 50 μm | 10 m/s | 3/1 | 2.4 μm | 11 | 9 |
| Ex. 23 | Zirconia | 50 μm | 12 m/s | 3/1 | 2.4 μm | 8 | 10 |
| Ex. 24 | Zirconia | 30 μm | 12 m/s | 3/1 | 2.4 μm | 10 | 7 |
| Comp. Ex. 10 | Alumina | 5 mm | — | 3/1 | 2.4 μm | 30 | 110 |

The electrophotographic photoreceptor of the present invention has favorable photoreceptor characteristics and is resistant to dielectric breakdown, and has very excellent properties such as capable of providing an image with very few image defects such as color spots.

Example 25

The photoreceptor Q1 prepared in Example 13 was fixed in an environment at 25° C. at 50%, a charging roller shorter by about 2 cm at each end by the drum length and having a volume resistivity of about 2 MΩ·cm was pressed against the photoreceptor, and a direct voltage of −1 kV was applied for one minute and then a direct voltage of −1.5 kV was applied for one minute, and a voltage was decreased by −0.5 kV every time after application for one minute, whereupon the photoreceptor underwent dielectric breakdown upon application of a direct voltage of −4.5 kV.

Example 26

A photoreceptor was prepared in the same manner as in Example 13 except that the coating fluid D for forming an undercoat layer was used instead of the coating fluid B for forming an undercoat layer prepared in Example 13, and a direct voltage was applied to the photoreceptor in the same manner as in Example 25, whereupon the photoreceptor underwent dielectric breakdown upon application of a direct voltage of −4.5 kV.

Comparative Example 11

A direct voltage was applied to a photoreceptor in the same manner as in Example 25 except that the photoreceptor T1 prepared in Comparative Example 6 was used instead of the photoreceptor Q1 prepared in Example 13, whereupon the photoreceptor underwent dielectric breakdown upon application of a direct voltage of −3.5 kV.

Example 27

The photoreceptor Q1 prepared in Example 13 was mounted on a printer ML1430 manufactured by Samsung, and image formation was repeatedly carried out at an image density of 5% until an image defect by dielectric breakdown was observed, but no image defect was observed even after formation of 50,000 images.

Comparative Example 12

The photoreceptor T1 prepared in Comparative Example 6 was mounted on a printer ML1430 manufactured by Samsung, and image formation was repeatedly carried out at an image density of 5% until an image defect by dielectric breakdown was observed, whereupon an image defect was observed after formation of 35,000 images.

Example 28

The coating fluid B for forming an undercoat layer was applied on an aluminum cut tube having an outer diameter of 24 mm, a length of 236.5 mm and a thickness of 0.75 mm by dip coating so that the film thickness after drying was 2 μm and dried to form an undercoat layer.

1.5 parts of a charge generation material of the following formula:

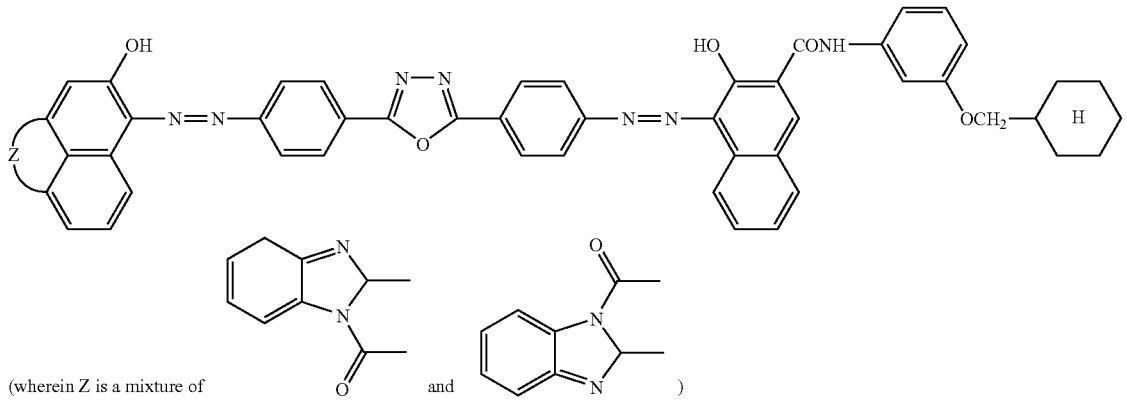

and 30 parts of 1,2-dimethoxyethane were mixed and pulverized by a sand grinding mill for 8 hours to conduct atomization and dispersion treatment. Then, the mixture was mixed with a binder solution having 0.75 part of polyvinyl butyral ("DENKA BUTYRAL" #6000C, trade name, manufactured by Denki Kagaku Kogyo Kabushiki Kaisha) and 0.75 part of a phenoxy resin (PKHH), manufactured by Union Carbide Corporation) dissolved in 28.5 parts of 1,2-dimethoxyethane, and finally 13.5 parts of a mixed liquid of 1,2-dimethoxyethane and 4-methoxy-4-methyl-2-pentanol in an optional ratio was added thereto to prepare a coating fluid for forming a charge generation layer having a solid content (pigment and resin) concentration of 4.0 wt %. This coating fluid for forming a charge generation layer was applied on the above undercoat layer by dip coating so that the film thickness after drying was 0.6 μm and dried to form a charge generation layer.

Then, on the charge generation layer, a coating fluid for a charge transfer layer having 67 parts of the following triphenylamine compound:

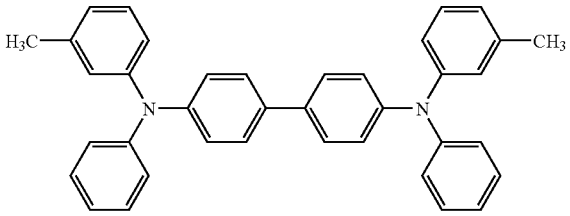

100 parts of a polycarbonate resin having the following repeating structure:

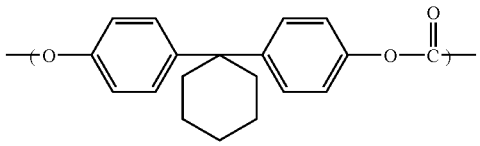

0.5 part of a compound of the following structure:

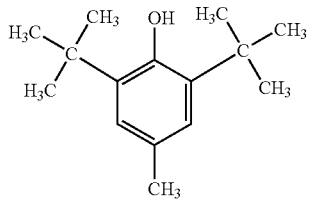

and 0.02 part of a silicone oil dissolved in 640 parts of a solvent mixture of tetrahydrofuran/toluene (8/2) was applied so that the film thickness after drying was 25 μm and air-dried at room temperature for 25 minutes and further dried at 125° C. for 20 minutes to provide a charge transport layer thereby to prepare an electrophotographic photoreceptor.

The above obtained electrophotographic photoreceptor was set to an electrophotographic characteristic evaluation apparatus (described on pages 404 to 405 in "Electrophotography—Bases and Applications, second series" edited by the Society of Electrophotography, published by CORONA PUBLISHING CO., LTD.), manufactured in accordance with the measurement standard by the Society of Electrophotography, and electric characteristics were evaluated by cycles of charging, exposure, potential measurement, and charge removal, in accordance with the following procedure.

The initial surface potential of the photoreceptor was measured when charged by carrying out discharge at a grid voltage of −800 V by a scorotron charger at dark place. Then, the photoreceptor was irradiated with a monochromatic light at 450 nm which was obtained by making a light from a halogen lamp to pass through an interference filter, and the irradiation energy (μJ/cm$^2$) when the surface potential became −350 V was measured and regarded as the sensitivity E1/2, whereupon the initial charge potential was −708 V and the sensitivity E1/2 was 3.288 μJ/cm$^2$. A higher initial charge potential (a larger absolute value of the potential) indicates better chargeability, and a smaller sensitivity value represents higher sensitivity.

Comparative Example 13

An electrophotographic photoreceptor was prepared in the same manner as in Example 28 except that the coating fluid H for forming an undercoat layer prepared in Comparative Example 1 was used as the coating fluid for forming an undercoat layer; and electric characteristics were evaluated in the same manner as in Example 28 and as a result, the initial charge potential was −696 V and the sensitivity E1/2 was 3.304 μJ/cm$^2$.

As is evident from the results in Example 28 and Comparative Example 13, the electrophotographic photoreceptor of the present invention is excellent in sensitivity particularly when exposed with a monochromatic light having an exposure wavelength of from 350 nm to 600 nm.

INDUSTRIAL APPLICABILITY

The coating fluid for forming an undercoat layer of the present invention has high storage stability, and is capable of producing a high quality electrophotographic photoreceptor having an undercoat layer obtained by applying the coating fluid with high efficiency. Such an electrophotographic photoreceptor is excellent in durable stability, and image defects or the like hardly occur with it, and accordingly by an image forming apparatus using such a photoreceptor, a high quality image can be formed. Further, according to the method for producing the coating fluid, the coating fluid for forming an undercoat layer can be produced with high efficiency and in addition, a coating fluid for forming an undercoat layer having a higher storage stability can be obtained, and thus a higher quality electrophotographic photoreceptor can be obtained. Thus, the present invention is applicable in various fields in which an electrophotographic photoreceptor is used, such as fields of copying machines, printers and printing machines.

The entire disclosure of Japanese Patent Application No. 2004-336424 filed on Nov. 19, 2004 including specification, claims, drawings and summary is incorporated herein by reference in its entirety.

The invention claimed is:

1. An electrophotographic photoreceptor, comprising an electroconductive substrate, an undercoat layer comprising a binder resin and a metal oxide particle having a refractive index in a range of from 2.0 to 3.0 formed on the electroconductive substrate, and a photosensitive layer formed on the undercoat layer, wherein when a dispersion liquid is prepared by dispersing the undercoat layer in a solvent mixture of methanol and 1-propanol in a weight ratio of 7:3, the dispersion liquid provides a difference of at most 0.3 (Abs) between an absorbance to light having a wavelength of 400 nm and an absorbance to light having a wavelength of 1,000 nm.

2. An electrophotographic photoreceptor, comprising an electroconductive substrate, an undercoat layer comprising a binder resin and a metal oxide particle having a refractive index in a range of from 2.0 to 3.0 formed on the electroconductive substrate, and a photosensitive layer formed on the undercoat layer, wherein the undercoat layer is formed by applying a coating fluid wherein when a liquid is prepared by diluting the coating fluid with a solvent mixture of methanol and 1-propanol in a weight ratio of 7:3, the liquid provides a difference of at most 1.0 (Abs) between an absorbance to light having a wavelength of 400 nm and an absorbance to light having a wavelength of 1,000 nm.

3. The electrophotographic photoreceptor according to claim 1, wherein the metal oxide particle is at least one selected from the group consisting of aluminum oxide, silicon oxide, zirconium oxide, zinc oxide and iron oxide.

4. The electrophotographic photoreceptor according to claim 3, wherein a weight ratio of the metal oxide and the binder resin is of from 3/1 to 4/1 in the undercoat layer.

5. The electrophotographic photoreceptor according to claim 2, wherein a weight ratio of the metal oxide and the binder resin is of from 3/1 to 4/1 in the undercoat layer.

6. The electrophotographic photoreceptor according to claim 2, wherein the metal oxide particle is at least one selected from the group consisting of aluminum oxide, silicon oxide, zirconium oxide, zinc oxide and iron oxide.

7. The electrophotographic photoreceptor according to claim 6, wherein a weight ratio of the metal oxide and the binder resin is of from 3/1 to 4/1 in the undercoat layer.

8. The electrophotographic photoreceptor according to claim 2, wherein a weight ratio of the metal oxide and the binder resin is of from 3/1 to 4/1 in the undercoat layer.

9. The electrophotographic photoreceptor according to claim 1, wherein the binder resin is selected from the group consisting of a phenoxy resin, an epoxy resin, polyvinylpyrrolidone, polyvinyl alcohol, casein, polyacrylic acid, celluloses, gelatin, starch, polyurethane, polyimide, and polyamide.

10. The electrophotographic photoreceptor according to claim 2, wherein the binder resin is selected from the group consisting of a phenoxy resin, an epoxy resin, polyvinylpyrrolidone, polyvinyl alcohol, casein, polyacrylic acid, celluloses, gelatin, starch, polyurethane, polyimide, and polyamide.

11. The electrophotographic photoreceptor according claim 1, wherein a size of the metal oxide particle is at most 0.1 μm.

12. The electrophotographic photoreceptor according to claim 2, wherein a size of the metal oxide particle is at most 0.1 μm.

13. The electrophotographic photoreceptor according to claim 1, wherein a size of the metal oxide particle is in a range of from 0.07 to 0.09 μm.

14. The electrophotographic photoreceptor according to claim 2, wherein a size of the metal oxide particle is in a range of from 0.07 to 0.09 μm.

15. The electrophotographic photoreceptor according to claim 1, wherein the undercoat layer consists of one or more metal oxides and one or more binder resins wherein: the one or more metal oxides are selected from the group consisting of aluminum oxide, silicon oxide, zirconium oxide, zinc oxide and iron oxide; and the one or more binder resins are selected from the group consisting of a phenoxy resin, an epoxy resin, polyvinylpyrrolidone, polyvinyl alcohol, casein, polyacrylic acid, celluloses, gelatin, starch, polyurethane, polyimide, and polyamide.

16. The electrophotographic photoreceptor according to claim 2, wherein the undercoat layer consists of one or more metal oxides and one or more binder resins wherein: the one or more metal oxides are selected from the group consisting of aluminum oxide, silicon oxide, zirconium oxide, zinc oxide and iron oxide; and the one or more binder resins are selected from the group consisting of a phenoxy resin, an epoxy resin, polyvinylpyrrolidone, polyvinyl alcohol, casein, polyacrylic acid, celluloses, gelatin, starch, polyurethane, polyimide, and polyamide.

17. The electrophotographic photoreceptor according to claim 1, wherein the undercoat layer is formed by a process comprising dispersing the metal oxide particles by a dispersing medium having an average particle size of from 5 to 200 μm.

18. The electrophotographic photoreceptor according to claim 2, wherein the undercoat layer is formed by a process comprising dispersing the metal oxide particles by a dispersing medium having an average particle size of from 5 to 200 μm.

19. The electrophotographic photoreceptor according to claim 1, comprising an undercoat layer comprising a binder resin and a metal oxide particle having a refractive index in a range of from 2.0 to 3.0 formed on the electroconductive substrate, and a photosensitive layer formed on the undercoat layer, wherein the metal oxide particle is dispersion treated with a dispersion medium having an average particle size in a range of from 5 to 50 μm to obtain the undercoat layer, and wherein when a dispersion liquid is prepared by dispersing the undercoat layer in a solvent mixture of methanol and 1-propanol in a weight ratio of 7:3, the dispersion liquid provides a difference in a range of from 0.014 to 0.3 (Abs) between an absorbance to light having a wavelength of 400 nm and an absorbance to light having a wavelength of 1,000 nm.

20. The electrophotographic photoreceptor according to claim 2, comprising an electroconductive substrate, an undercoat layer comprising a binder resin and a metal oxide particle having a refractive index in a range of from 2.0 to 3.0 formed on the electroconductive substrate, and a photosensitive layer formed on the undercoat layer, wherein the metal oxide particle is dispersion treated with a dispersion medium having an average particle size in a range of from 5 to 50 μm to obtain the undercoat layer, and wherein the undercoat layer is formed by applying a coating fluid wherein when a liquid is prepared by diluting the coating fluid with a solvent mixture of methanol and 1-propanol in a weight ratio of 7:3, the liquid provides a difference in a range of from 0.014 to 1.0 (Abs) between an absorbance to light having a wavelength of 400 nm and an absorbance to light having a wavelength of 1,000 nm.

21. The electrophotographic photoreceptor according to claim 1, wherein the electrophotographic photoreceptor has a dielectric breakdown time in a range of from 16.1 to 21.8 min.

22. The electrophotographic photoreceptor according to claim 2, wherein the electrophotographic photoreceptor has a dielectric breakdown time in a range of from 16.1 to 21.8 min.

* * * * *